US008141708B2

(12) United States Patent
McDowell

(10) Patent No.: US 8,141,708 B2
(45) Date of Patent: Mar. 27, 2012

(54) CONTAINER FOR GLASS PRODUCTS

(75) Inventor: Richard B. McDowell, Ligonier, PA (US)

(73) Assignee: Menasha Corporation, Neenah, WI (US)

( * ) Notice: Subject to any disclaimer, the term of this patent is extended or adjusted under 35 U.S.C. 154(b) by 899 days.

(21) Appl. No.: 11/912,748

(22) PCT Filed: Jul. 6, 2007

(86) PCT No.: PCT/US2007/015528

§ 371 (c)(1), (2), (4) Date: Oct. 26, 2007

(87) PCT Pub. No.: WO2008/008272

PCT Pub. Date: Jan. 17, 2008

(65) Prior Publication Data

US 2009/0301916 A1 Dec. 10, 2009

Related U.S. Application Data

(63) Continuation-in-part of application No. 11/483,063, filed on Jul. 7, 2006, now Pat. No. 7,441,658.

(51) Int. Cl.
*B65D 85/48* (2006.01)

(52) U.S. Cl. ..... 206/448

(58) Field of Classification Search ..... 206/451, 206/454, 449, 448

See application file for complete search history.

(56) References Cited

U.S. PATENT DOCUMENTS 2,171,051 A 8/1939 Stonecypher (Continued)

FOREIGN PATENT DOCUMENTS

CA 1097283 3/1981

(Continued)

OTHER PUBLICATIONS

International Search Report for PCT/US07/015528 mailed Jul. 11, 2008.

*Primary Examiner* — Jacob K Ackun

(74) *Attorney, Agent, or Firm* — Ungaretti & Harris LLP

(57) ABSTRACT

A container for transporting a plurality of curved glass sheets lined up side by side. The container includes a bottom structure, such as a pallet, a back wall extending upward from the bottom structure, a first side wall connected to a first end of the back wall and extending upward from the bottom structure, and a second side wall connected to a second end of the back wall and extending upward from the bottom structure. The container includes a cradle portion proximate the back wall extending into an interior portion of the container. The cradle portion including a glass sheet supporting surface for contacting a backmost one of the plurality of glass sheets. The supporting surface has a radius of curvature to correspond with the curvature of the backmost one of the plurality of glass sheets. The container can have two or more cradle portions. The container also includes two back corner support structures, each configured to support a portion of the respective side walls and a portion of the back wall. A banding system and method are also provided for securing a plurality of glass sheets in a container for transporting the glass sheets. The system includes a central support member having a plurality of openings for adjustably positioning a band internally in the container to coincide with the frontmost glass sheet. The central support member includes an opening to allow the band to anchor the central support member securely against the back wall of the container.

20 Claims, 17 Drawing Sheets

U.S. PATENT DOCUMENTS

| | | | | | |
|---|---|---|---|---|---|
| 2,331,753 | A | | 10/1943 | Wohlers | |
| 2,665,804 | A | | 1/1954 | Koester | |
| 2,673,023 | A | | 3/1954 | Vander Lugt, Jr. | |
| 2,734,626 | A | | 2/1956 | Koester et al. | |
| 2,743,010 | A | | 4/1956 | Koester | |
| 2,806,592 | A | | 9/1957 | Hatfield | |
| 2,839,198 | A | | 6/1958 | Lefevre | |
| 2,981,407 | A | | 4/1961 | Gaulke et al. | |
| 3,159,275 | A | | 12/1964 | Van Antwerpen et al. | |
| 3,403,778 | A | | 10/1968 | Voytko et al. | |
| 3,469,762 | A | | 9/1969 | La Torre | |
| 3,476,303 | A | | 11/1969 | Smith | |
| 3,493,128 | A | | 2/1970 | Silvert | |
| 3,519,244 | A | | 7/1970 | Lidgard | |
| 3,616,986 | A | | 11/1971 | Wolfe | |
| 3,884,356 | A | | 5/1975 | Lidgard | |
| 3,938,660 | A | | 2/1976 | Moehring | |
| 3,964,608 | A | * | 6/1976 | Rowley | 206/451 |
| 3,985,231 | A | | 10/1976 | Farhat et al. | |
| 3,995,738 | A | * | 12/1976 | Rowley et al. | 206/451 |
| 4,010,849 | A | * | 3/1977 | Pater et al. | 206/448 |
| 4,014,435 | A | | 3/1977 | Rowley et al. | |
| 4,086,263 | A | | 4/1978 | Rowley | |
| 4,098,401 | A | | 7/1978 | Brown et al. | |
| 4,225,043 | A | | 9/1980 | Lastik | |
| 4,273,485 | A | * | 6/1981 | Fischer et al. | 410/34 |
| 4,317,536 | A | | 3/1982 | Dickerson | |
| 4,467,922 | A | | 8/1984 | Rowley | |
| 4,477,015 | A | | 10/1984 | Lozaun | |
| 4,489,835 | A | | 12/1984 | Tombal et al. | |
| 4,697,731 | A | | 10/1987 | Snyder | |
| 5,105,946 | A | * | 4/1992 | McDowell | 206/454 |
| 5,145,073 | A | * | 9/1992 | Kitagawa et al. | 211/41.14 |
| 5,174,448 | A | * | 12/1992 | Flaig | 206/386 |
| 5,269,422 | A | * | 12/1993 | Chevrette | 206/448 |
| 5,372,255 | A | | 12/1994 | Skorski | |
| 5,575,389 | A | | 11/1996 | Alspach | |
| 6,267,255 | B1 | | 7/2001 | Brush | |
| 2004/0016669 | A1 | * | 1/2004 | Allison | 206/448 |

FOREIGN PATENT DOCUMENTS

| | | |
|---|---|---|
| GB | 1332546 | 10/1973 |

* cited by examiner

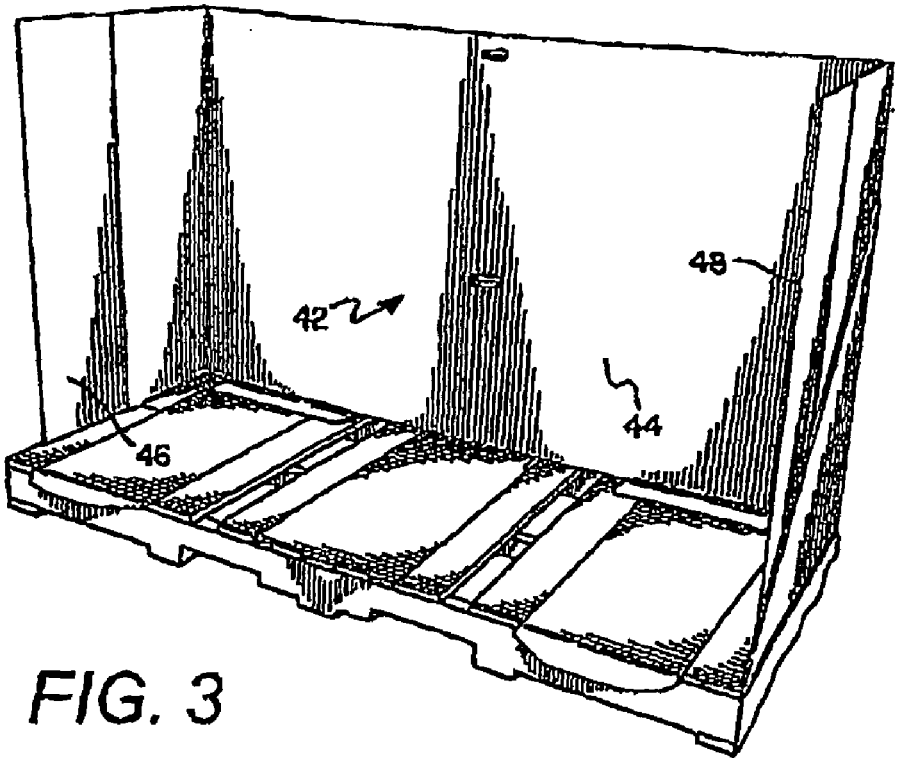
FIG. 3
FIG. 4
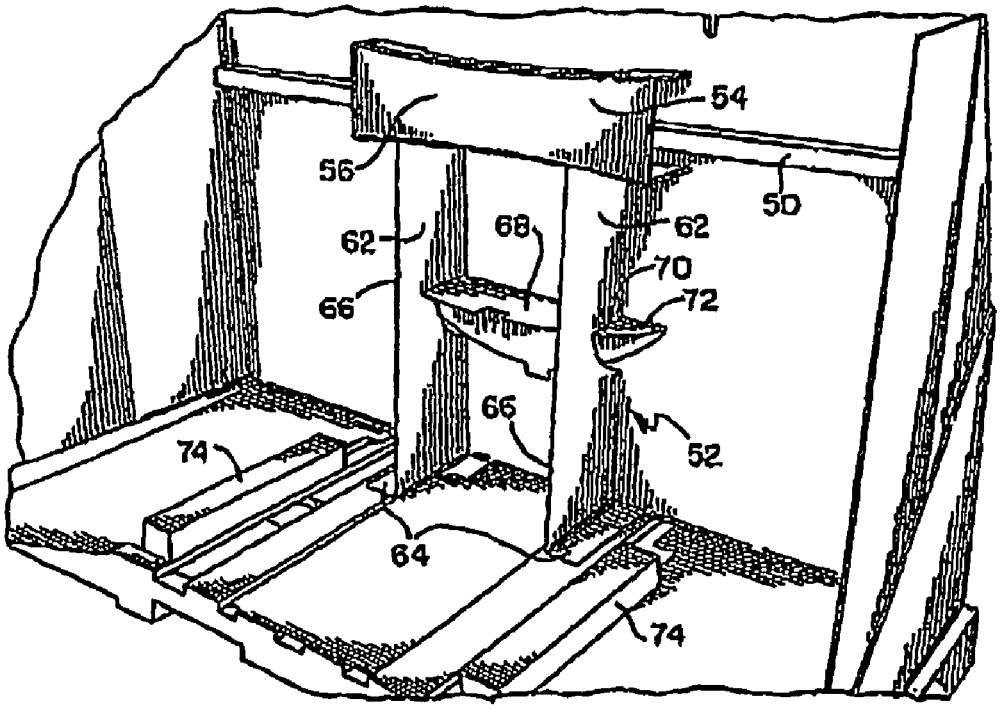

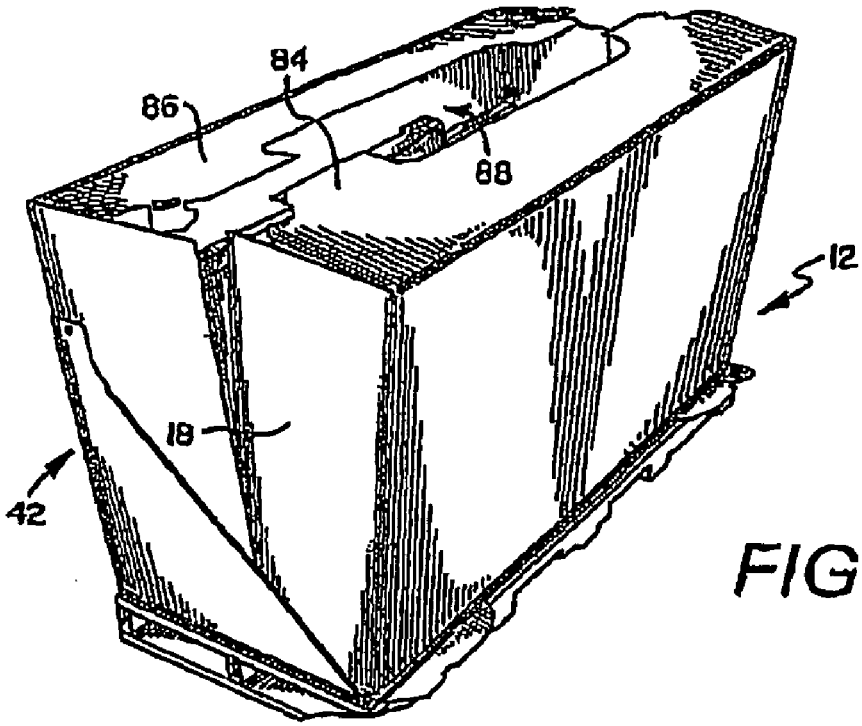
FIG. 7
FIG. 8
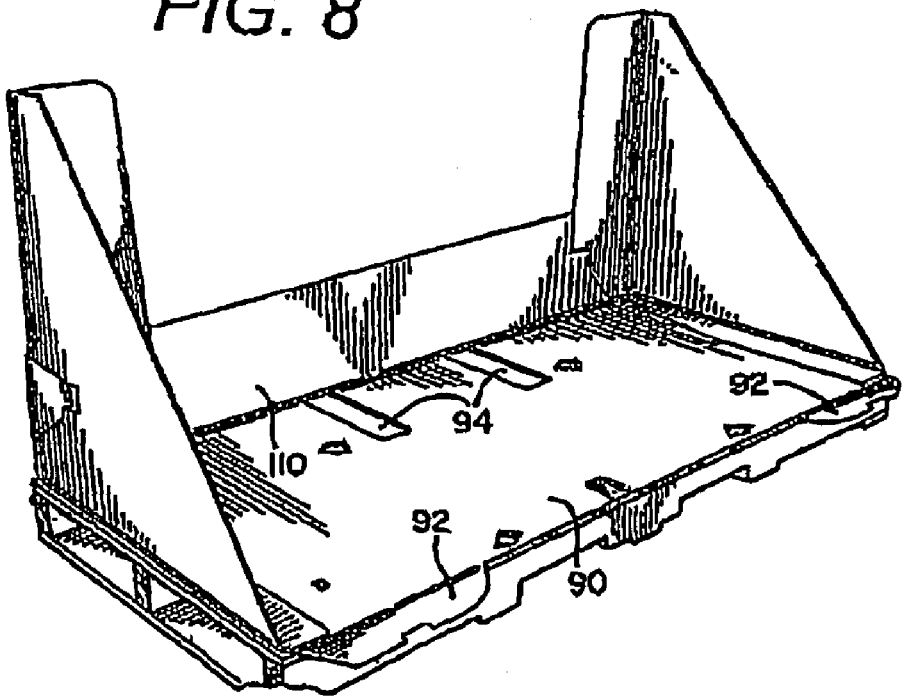

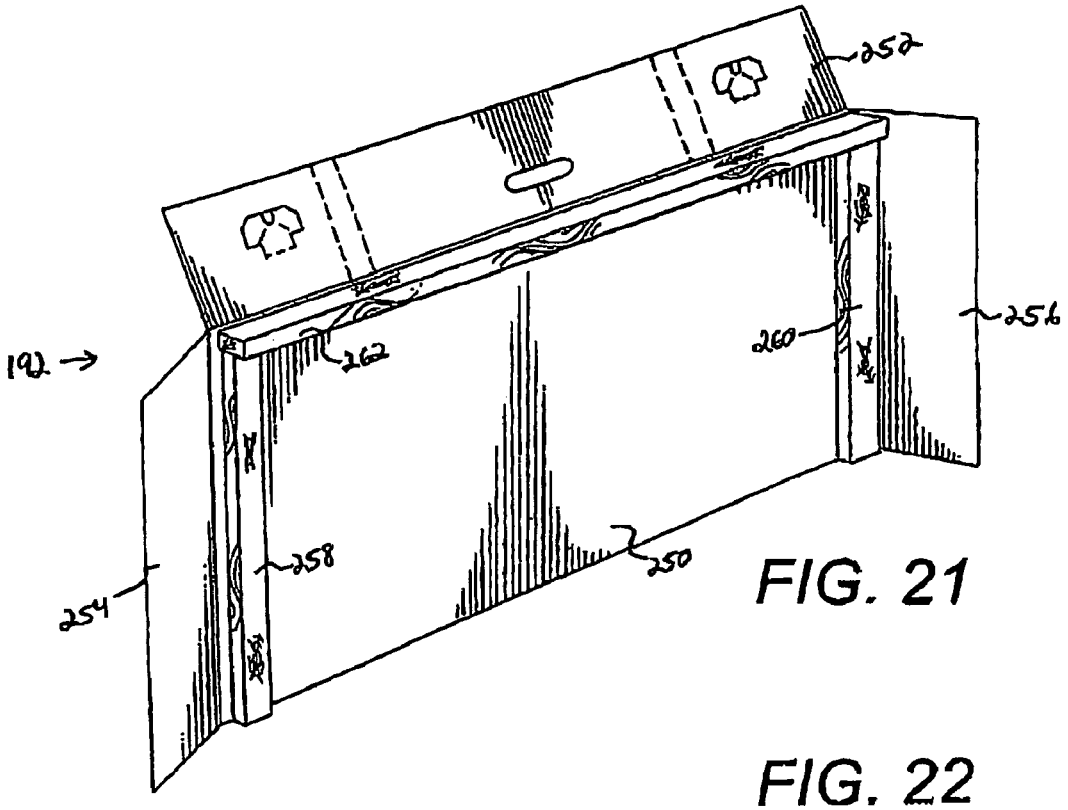
FIG. 21
FIG. 22
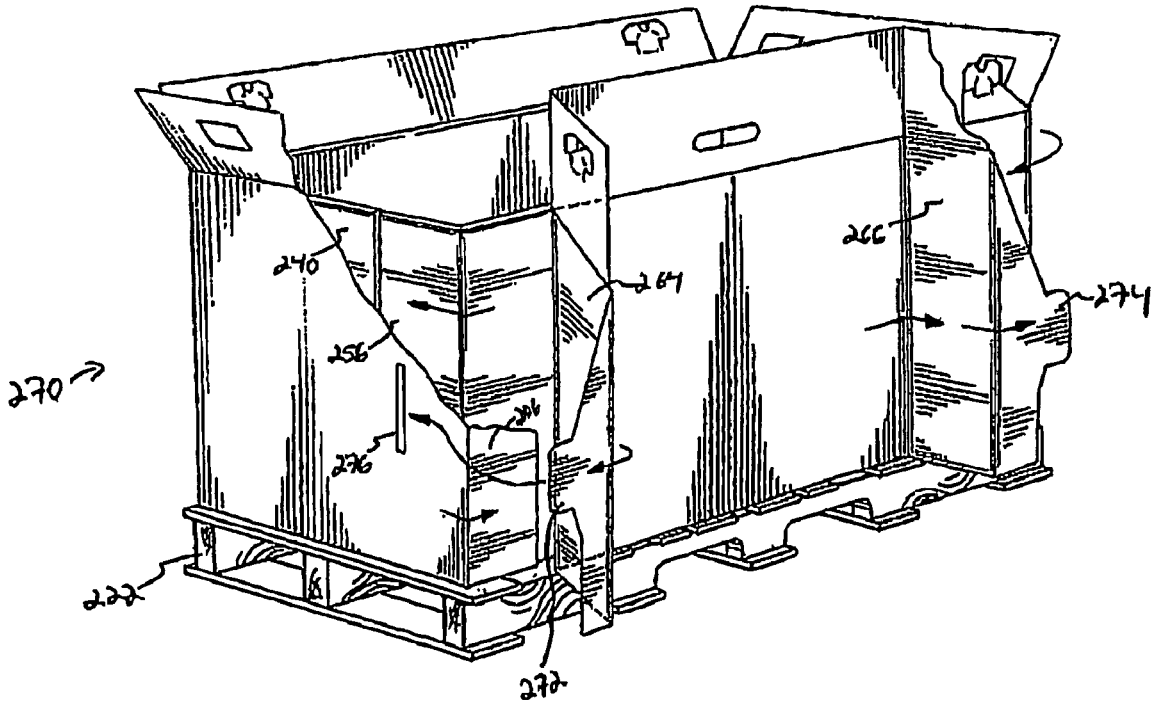

CONTAINER FOR GLASS PRODUCTS

CROSS-REFERENCE TO RELATED APPLICATIONS

The present application is a 371 application and claims the benefit of PCT Application Serial No. PCT/US2007/015528, filed Jul. 6, 2007, which is a continuation-in-part application and claims the benefit of U.S. Ser. No. 11/483,063, filed Jul. 7, 2006.

FEDERALLY SPONSORED RESEARCH OR DEVELOPMENT

N/A

TECHNICAL FIELD

The invention relates to a container for transporting fragile products and to a banding system for use with the container, and more particularly to a container having a cradle for transporting glass products, such as windshields used in the automotive industry and an adjustable banding system.

BACKGROUND OF THE INVENTION

Containers for shipping glass sheets, such as windshields used in automobiles and trucks, are typically corrugated structures or wood crates (or a combination thereof) supported on a wood pallet. The containers are preassembled or occasionally shipped in components to the glass sheet manufacturer and are set up or assembled on-site.

It is important for such containers to be able to securely support the glass and withstand the rigors of transportation and be capable of stacking to maximize warehouse space. This includes providing a snug fit for the glass. It is also necessary for the containers to withstand banding pressures from straps or bands utilized in shipping. It is important for the banding system to securely hold the glass sheets in the container.

The present invention is provided to solve the problems discussed above and other problems and to provide advantages and aspects not provided by prior containers of this type. A full discussion of the features and advantages of the present invention is deferred to the following detailed description, which proceeds with reference to the accompanying drawings.

SUMMARY OF THE INVENTION

The present invention is directed to a container for transporting sheets of glass, such as automotive windshields. The container is configured to support the glass sheets in an upright position (i.e., along each sheet's bottom or top edge), and includes a cradle support which conforms to the curve or bend of the sheet. That is, a supporting surface of the cradle support is contoured to provide a closer or more snug fit against the glass sheets. Thus, distributing the weight across the cradle surface without hard edges that could create pressure points. The container also includes back corner support structures configured to support a portion of the side walls and a portion of the back wall. A top having a reinforced lip to withstand banding pressures is also provided. The top can be a separate piece, or can be formed from flaps extending from other components of the container.

The container is made from components that can be shipped and stored in a relatively flat, or a condensed or compact configuration. The container is preferable then set up or assembled on location before being loaded with glass sheets.

In accordance with one embodiment of the invention, a container for transporting a plurality of curved glass sheets lined up side by side is provided. The container comprises a bottom structure, a back wall extending upward from the bottom structure, a first side wall connected to a first end of the back wall and extending upward from the bottom structure, and a second side wall connected to a second end of the back wall and extending upward from the bottom structure. The bottom structure can be a wooden or plastic pallet having end and side openings for forklift tines.

The container also includes a cradle portion proximate the back wall extending into an interior portion of the container. The cradle portion includes a glass sheet supporting surface for contacting a backmost one of the plurality of glass sheets. The supporting surface is configured to have a radius of curvature to parrot with the backmost one of the plurality of glass sheets. The cradle portion is supported by a first cradle support panel extending upward from the bottom structure to the cradle portion, and a second cradle support panel extending upward from the bottom structure to the cradle portion. The support panels include a front support surface inclined at an angle to the back wall of the container. A cross-support panel or brace can be provide between the first and second support panels, preferably a bout midway from the bottom structure to the cradle portion.

The container can further include a reinforcing member positioned and secured in the back half of the container extending along the back wall between the first side wall and the second side wall. The reinforcing member can be a wood beam. According to one variation of the container, the cradle portion is centered or positioned about the reinforcing member and located at a fixed height behind the glass sheets (when loaded onto the container) to provide maximum support against the reinforcing member which distributes weight to the corners of the container.

The back wall, first side wall, second side wall and cradle portion are formed from a corrugated material, such as cardboard. The back wall and side walls can be formed from a single blank having scorelines for folding the side walls.

The container can further include a first corner support structure configured to support a portion of the first side wall and a first portion of the back wall adjacent the portion of the first side wall and, a second corner support structure configured to support a portion of the second side wall and a second portion of the back wall adjacent the portion of the second side wall. The corner portions can also be formed from a corrugated material.

The container further comprises a front wall extending upward from the bottom structure and a top panel extending between the front wall and the back wall, and the first side wall and the second side wall. The front wall and top panel can also be formed from a corrugated material. Additionally, the front wall and the back wall can be identical.

In accordance with another embodiment of the invention, a container for transporting a plurality of curved glass sheets comprises a bottom pallet structure, a substantially rectangular back wall connected to a back edge portion of the bottom pallet and extending upward therefrom, the back wall including a first side wall connected to a first side of the back wall and a second side wall connected to a second side of the back wall. The container also includes a cradle portion connected to a mid portion of the back wall for engaging and supporting the plurality of curved glass sheets; a first corner support having a side support wall for supporting a portion of the first side wall and a back support wall for supporting a first portion of the back wall and a second corner support having a side support wall for supporting a portion of the second side wall and a back support wall for supporting a second portion of the back wall. The bottom pallet structure includes a floor portion comprising a corrugated material.

The cradle portion includes a curved cradle support surface having a contour configured to mate with the contour of the backmost curved glass sheet of the plurality of curved glass sheets. The cradle portion also includes a wall separation portion connected to the back wall and the cradle support surface for maintaining the cradle support surface in an interior portion of the container spaced from the back wall.

The container also comprises a reinforcing beam extending along the back wall. The reinforcing beam is positioned to be in line with the glass sheets. Importantly, the cradle portion is located at a fixed height, putting it and the reinforcing beam directly behind the glass sheets when loaded in the container. The wall separation portion is positioned so that it spans a mid-portion of the reinforcing beam.

The container further includes a front wall having a first side wall connected to a first side of the front wall and a second side wall connected to a second side of the front wall. The first side wall and the second side wall connected to the front wall are configured to overlap the first side wall and second side wall connected to the back wall.

The container further includes a corrugated top panel having a lip extending downward around the periphery of the top panel. The lip is reinforced to resist pressure from banding of the container. The reinforcement can be provided by having a plurality of layers of cardboard in the lip.

Alternatively, the top of the container can be formed from a first flap and a second flap extending from the front and back walls, respectively. The flaps can abut when folded to counter banding pressure.

In accordance with yet a further embodiment of the invention, a container for transporting a plurality of glass windshields used for automobiles is provided. The container includes a bottom structure, and a back wall connected to the bottom structure along a bottom edge of the back wall. The back wall includes a first side wall extending from a first side of the back wall and a second sidewall extending from a second side of the back wall. The back wall, first side wall and second side wall are formed from a contiguous corrugated cardboard blank.

The container also includes a corrugated cardboard cradle portion connected to the back wall. The cradle portion including a generally rectangular support surface having a curvature for mating with the plurality of glass windshields.

Additionally, the container includes a first corner support having a side supporting portion for supporting a portion of the first side wall and a back supporting portion for supporting a first portion of the back wall. The side supporting portion and the back supporting portion of the first corner support are formed from a contiguous corrugated cardboard blank. A second corner support having a side supporting portion for supporting a portion of the second side wall and a back supporting portion for supporting a second portion of the back wall can be provided for the other back corner of the container. Similar to the first corner support, the side supporting portion and the back supporting portion of the second corner portion are formed from a contiguous corrugated cardboard blank.

The container further comprises a front portion connected to the bottom structure. The front portion includes a front wall, a first side wall connected to a first side of the front wall and a second side wall connected to a second side of the front wall. The front wall, first side wall connected to the front wall and second side wall connected to the front wall are formed from a contiguous corrugated cardboard blank.

The container further comprises a corrugated cardboard top portion including a top panel surrounded by a lip. The lip includes a roll-up reinforcement to withstand banding pressure. Alternatively, the front wall and the back wall can each include a flap connected to the top edge of the walls. The flaps can be bent to form a top wall of the container.

In accordance with another aspect of the invention, a banding system and method for securing the glass sheets in the container is provided. The banding system and method of implementation ensures the glass sheets are constrained against the back of the container. The system and method also ensures the glass sheets are kept closely together during shipping.

According to one embodiment, a banding system for internally securely maintaining a plurality of glass sheets in container for transporting the glass sheets is provided. The banding system can be incorporated into the containers described above as well as in other containers. The banding system comprises a container having a bottom portion for supporting a plurality of glass sheets, and a back wall extending upwardly from the bottom portion. A top band support extends into an interior portion of the container from an upper portion of the back wall. The top band support includes a plurality of band positioning openings for adjustably positioning a band in accordance with the number of glass sheets being transported in the container. A vertical member extends from the top band support to the bottom portion. A band is then positioned around the back wall, top band support, vertical post and bottom portion to maintain the plurality of glass sheets securely in the container. The band utilizes the band positioning opening that is closest to the front of the plurality of glass sheets.

The top band support can be formed from a corrugated blank folded to have a plurality of layers. A front locking tab at a front end of the top band support and a back locking tab at a back end of top band support can be utilized to lock the plurality of layers together at a front end of the top band support.

A first and second projection can extend from the back end of the top support member. The first and second projections can cooperated with first and second mounting openings in the back wall. The mounting openings are sized for receiving the first projection extending from the back end of the top band support and the second projection extending from the back end of the top band support.

A back mounting opening can be formed in the top band support proximate the back end. Additionally, a band guide slot can be formed in the back locking tab. The band is positioned through the guide slot and the back mounting opening to securely maintain the top support member against the back wall of the container.

A first slot is formed in the back wall for routing the band to the top band support. Additionally, a top flap can extend from a top edged of the back wall. The flap can include a central fold down panel to easily allow the band to be routed into the container.

In accordance with another embodiment of the invention, a system for providing internal support to a plurality of glass sheets in a container for transporting the glass sheets is disclosed. The system comprises a pallet positioned as a bottom support for the container. The pallet supports a back wall, a front wall and opposing side walls. A central support member extends from an upper portion of the back wall into the interior of the container. The central support member includes a back mounting opening proximate a back end of the central support member and extending from a top surface of the central support member to a bottom surface of the central support member, and a first band support opening proximate a front end of the central support member and extending from the top surface to the bottom surface of the central support member. A vertical member is positioned extending from the pallet to the central support member. A second band support opening spaced from the first opening is positioned proximate the front end of the central support member and extending from the top surface to the bottom surface of the central support member. Additional band support openings can be provided.

In accordance with a further embodiment of the invention, a method for providing adjustable internal support for securely maintaining a plurality of glass sheets in a container is provided. The method comprises the steps of providing a container having a bottom support portion and a back wall for transporting a plurality of glass sheets; stacking a plurality of glass sheets on edge in the container; securing a central support member over a top edge of the plurality of glass sheets; providing a plurality of spaced openings proximate a front end of the central support member; routing a band over the bottom support, back wall and the central support member; selecting one of the plurality of openings proximate a front one of the plurality of glass sheets; and, routing the band through the selected one of the plurality of openings.

The step of securing a central support member over a top edge of the plurality of glass sheets can include providing a back mounting opening in the central support member; routing the band through a slot in the back wall and through the mounting opening; and, routing the band back to the slot in the back wall.

In accordance with a further embodiment of the invention, a banding system for internally securely maintaining a plurality of glass sheets in container for transporting the glass sheets is provided having an upper support member supported by the glass sheets. The banding system comprises a container having a bottom portion for supporting a plurality of glass sheets, and a back wall extending upwardly from the bottom portion. An upper support member is positioned on a top edge of a portion of the plurality of glass sheets proximate the frontmost sheet. A band is positioned around the back wall, upper support member, and bottom portion, and is tightened to maintain the plurality of glass sheets securely in the container.

The banding system further includes a support beam extending horizontally along an upper portion of the back wall. The support beam can be a wood beam which extends from the first side of the container to the second side of the container. Alternatively, the support beam can extend vertically from the bottom of the container or an intermediate position to the top of the back wall.

The upper support member can include a plurality of downwardly extending separators or flaps. The separators can fit between adjacent glass sheets to provide further support against any pressure exerted by the band. The upper support member can be formed from a corrugated material.

In accordance with yet another embodiment of the invention, a method for providing an internal support for securely maintaining a plurality of glass sheets in a container is provided. The method comprises the steps of providing a container having a bottom support portion and a back wall for transporting a plurality of glass sheets, stacking a plurality of glass sheets on edge in the container, placing a support member on to a top edge of a portion of the plurality of glass sheets and, routing a band over the bottom support portion, back wall and the upper support member. The method can further comprise providing a separator between adjacent glass sheets of the plurality of glass sheets under the upper support member.

In accordance with another embodiment of the invention, a container for transporting a plurality of glass sheets is provided having a unique cradle with two cradle portions. The cradle comprises a first cradle portion having a front surface for contacting a glass sheet, and, a second cradle portion spaced from the first cradle portion. The second cradle portion also having a front surface for contacting the glass sheet. Both the first cradle portion and the second cradle portion can have a radius of curvature corresponding to a radius of curvature of the glass sheets. The first cradle portion and the second cradle portion can be formed from a corrugated material.

The first cradle portion is positioned proximate a back wall of the container so that the front surface of the first cradle portion is at a first distance from the back wall. The second cradle portion is positioned proximate the back wall of the container so that the front surface of the second cradle portion is positioned at a second distance from the back wall greater than the first distance. The second cradle portion is positioned below the first cradle portion. This creates a slanted or inclined configuration.

The cradle further comprises at least a first internal support positioned in the first cradle portion, and at least a first internal support positioned in the second cradle portion. The internal supports can be formed from a corrugated material.

In accordance with yet another embodiment of the invention, a container for transporting glass sheets comprises a back section having a back wall, a first side wall and an opposing second side wall, the back wall, first side wall and second side wall supported on a bottom portion, and a cradle having a first cradle support portion and a second cradle support portion spaced from the first cradle support portion. The container further includes a front section configured to mate with the back section to form the container. The bottom portion can include a pallet structure.

The first side wall of the container includes a first front panel integrally connected to an edge of the first side wall. Similarly, the second side wall includes a second front panel integrally connected to an edge of the second side wall. The front panels can include a top flap configured to interlock with a top panel of the container.

The first cradle portion includes a front surface having a radius of curvature configured to match the radius of curvature of the glass sheets. Additionally, the second cradle portion includes a front surface having a radius of curvature configured to match the radius of curvature of the glass sheets. The front surface of the first cradle portion is positioned a first distance from the back wall and the front surface of the second cradle portion is positioned a second distance from the back wall. The second distance is greater than the first distance so that the cradle portions collectively provide an inclined surface for the glass sheets to lean against.

A first vertical brace is connected to the back wall and a second vertical brace connected to the back wall. A horizontal brace is connected to the back wall. The horizontal brace extending from a first side of the back wall to a second side of the back wall. The first vertical brace and the second vertical brace extend from the bottom portion of the container to the horizontal brace. The braces can be connected by nails or staples or other suitable means (e.g., glue).

The first cradle portion and the second cradle portion are mounted onto the first vertical brace and the second vertical brace. The first vertical brace is above and spaced apart from the second vertical brace.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 3 is a perspective view of container components of FIG. 2 including a back portion;

FIG. 4 is a perspective view of the container components of FIG. 3 including a cradle portion;

FIG. 7 is a perspective view of another embodiment of a container for glass sheets in accordance with the present invention;

FIG. 8 is a perspective view of components of an alternative embodiment of the container including a single floor support;

FIG. 21 is a perspective view of a front portion of a container in accordance with the embodiment of FIG. 20;

FIG. 22 is a perspective view of a container with a locking mechanism in a partially open position;

DETAILED DESCRIPTION

Figure 1:
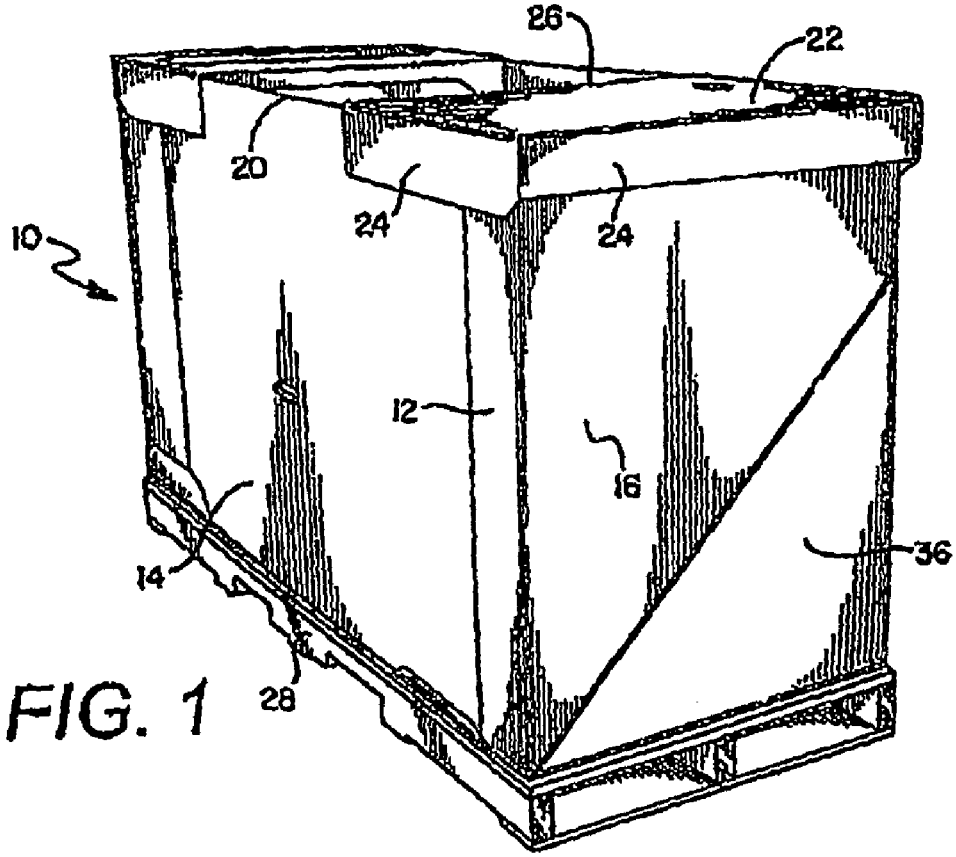
FIG. 1 is a perspective view of a container for glass sheets made in accordance with the teachings of an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a container for transporting sheets of glass, such as glass windshields utilized for automobiles. The container is constructed from components that can be collapsed for shipping. The containers can then be set up on location (e.g., a windshield manufacturing facility) and loaded with the glass sheets.

Referring to FIG. 1, a container 10 for holding glass sheets is shown. The container 10 includes a front section 12 having a front wall 14. The front section 12 further includes a first side wall 16 integrally connected to the front wall 14 along one side, and a second opposing side wall 18 (see FIG. 18) extending from the front wall 14 along the front wall's other side. The front section 12 is preferably formed from a corrugated cardboard material. The material is cut as single blank piece where the side walls 16,18 are formed by bending the blank at the appropriate locations. Scorelines or hinge lines can be formed in the blank to facilitate bending the material to form the desired shape of the front section 12. Similar techniques can be used for other components of the container 10.

The container includes a corrugated cardboard cap or top portion 20 having a top wall 22 and a lip 24 extending around the entire periphery of the top wall 22. The lip 24 includes reinforcement to withstand banding pressures from straps placed around the container 10 during shipping. The reinforcement can be provided by folding over several layers of the corrugated cardboard when forming the lip 24.

The top portion 20 also includes an opening 26 for allowing visual inspection of the glass sheets during transport and/or storage. The opening 26 also allows for placement and removal of dunnage used to secure the glass sheets in the container 10 and acting as shock absorbing material.

Figure 2:
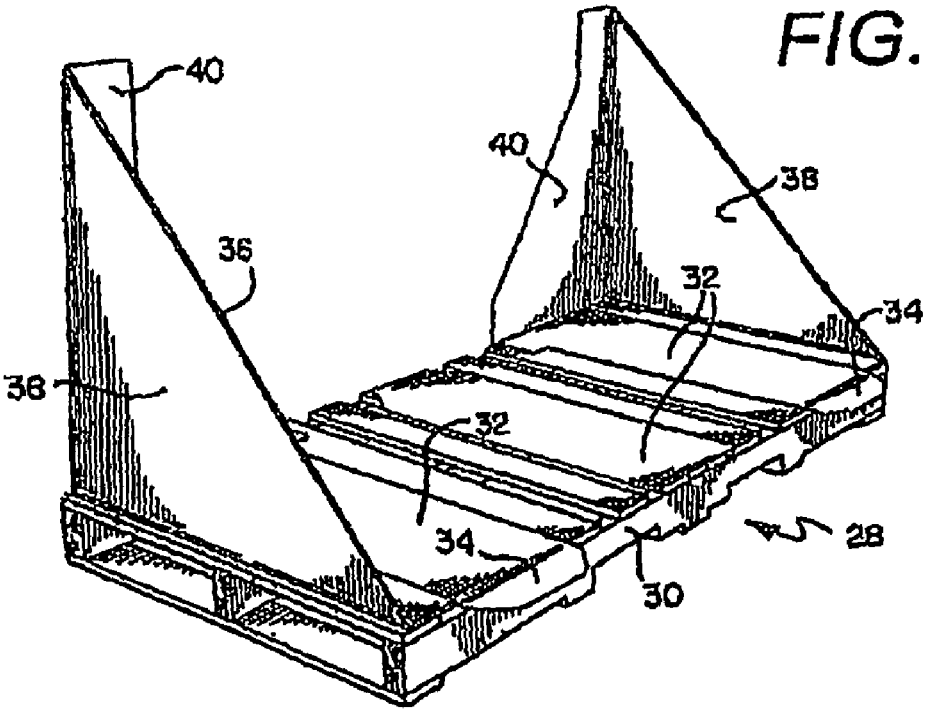
FIG. 2 is a perspective view of components of the container of FIG. 1 including a bottom portion and corner portions of the container.

The front section 12 is supported on a bottom portion 28. As shown in FIG. 2, the bottom portion 28 includes a wood frame pallet structure 30, and corrugated floor supports 32. The floor supports 32 on the ends of the pallet 30 include a tab 34 that extends outward beyond the front of the pallet frame structure 30 that can be used to facilitate connection of the bottom portion 28 to the front section 12. Similar tabs at the back of the floor supports 32 can be used to connect the supports to the back portions of the container.

The container 10 also includes two corrugated cardboard corner supports 36 positioned toward the back two corners of the container 10. Each corner support 36 includes a side support portion 38. The side support portion 38 has inclines with a diagonal edge starting towards the top from the back and ending towards the front of the container 10 near the pallet. The material is double thickness where fastened to the pallet 30 for maximum tear resistance. Also, each corner support 36 includes a back support portion 40 for supporting a portion of a back section 42 (see e.g., FIG. 3) of the container 10.

As shown in FIG. 3, the back section 42 includes a back wall 44 integrally connected to a first side wall 46 and a second side wall 48. The side walls 46,48 of the back section 42 are configured to fit within the side walls 16,18 of the front section 12 when the container 10 is fully set up. Similar to the front section 12, the back section 42 is preferably configured from a single blank piece of material.

Figure 5:
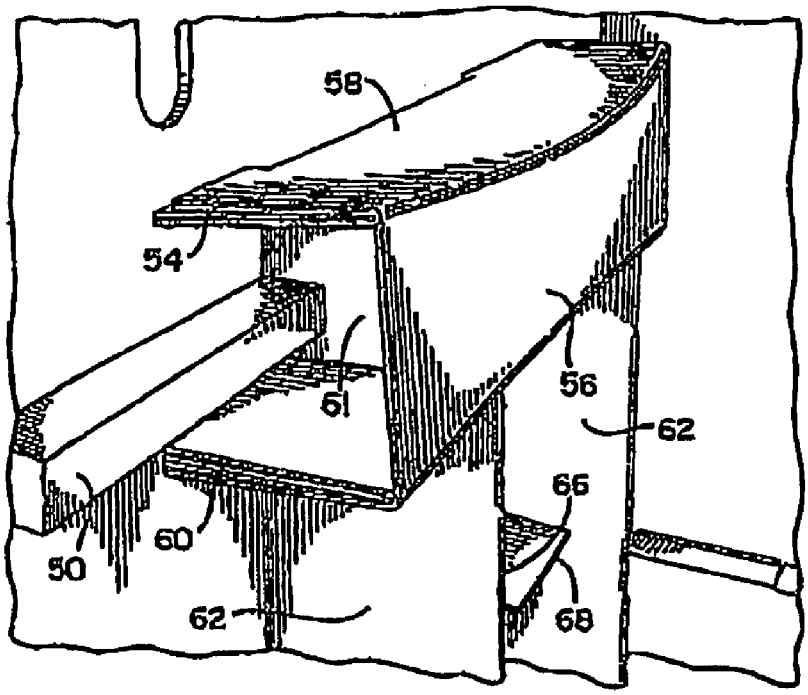
FIG. 5 is a perspective view of a portion of the cradle portion of FIG. 4.

FIGS. 4 and 5 show internal structure used in the container 10 for supporting the glass sheets and providing additional reinforcement to the container 10. A wood beam or brace 50 is positioned along the back wall 44. The brace 50 spans from the first side wall 46 to the second side wall 48, and is in line with a cradle portion 54.

A corrugated cardboard cradle 52 is also positioned midway against the back wall 44. The cradle 52 extends from the bottom portion 28 to just above the brace 50. The cradle 52 includes the cradle portion 54 having a front facing cradle support surface 56, a top member 58 and a bottom member 60 extending from the top and bottom, respectively, of the front surface 56 to the back wall 44. The cradle portion 54 is centered about the brace 50 and includes an internal support structure 61 (as shown in FIG. 5) between the support surface 56, top member 58, bottom member 60 and the brace 50.

The cradle portion 54 is supported by two cradle support panels 62. The support panels 62 extend from the bottom portion 28 to the bottom member 60 of the cradle portion 54. Each panel 62 includes a flap 64 glued or otherwise secured to the bottom portion 28. The panels 62 include a front facing edge 66 inclined at an angle with respect to the plane of the back wall 44. That is, the base of each panel 62 is wider than the top portion of the panel 62 connected to the bottom member 60 of the cradle portion 54.

A cross-support panel 68 is provided between the support panels 62 to brace the panels 62. The cross-support panel 68 is positioned to bridge the cradle support panels 62 at a mid-portion of the panels 62. One or more of the support panels 62 can be provided with a slot 70 to allow a portion 72 of the cross-panel 68 to extend outside of the panels 62.

In operation, the glass sheets are slightly leaned against the cradle 52 during transportation in the container 10. In this manner, the sheets are supported against the back of the container and will not fall over when the container is opened or the front portion 12 is removed.

The cradle support surface 56 is shown having a generally elongated rectangular shape. Additionally, the support surface is slightly arcuate or curved (as shown in FIG. 5) to match the curve of the glass sheets. The contour of the support surface 56 allows the support surface 56 to more effectively engage the glass sheets and provide support during transportation and storage.

Referring again to FIG. 4, the interior of the container 10 also includes two corrugated cardboard glass sheet supports 74. The supports 74 are formed by combining several corrugated sheets so as to form a core. Each support 74 is in the shape of a beam extending along the bottom portion 28 from the front to the back of the container 10. The glass sheet supports 74 are positioned so that the cradle 52 is centered between the supports 74.

Figure 6:
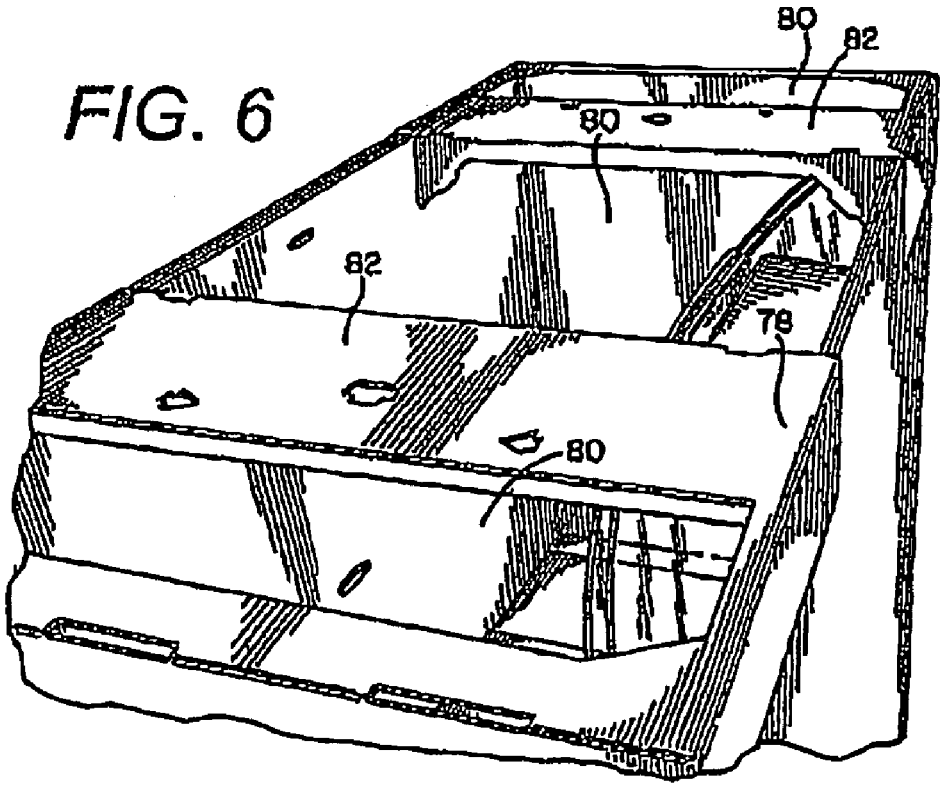
FIG. 6 is a perspective view of the top of one embodiment of a container for glass sheets in accordance with the present invention.

As illustrated in FIG. 6, a plurality of glass sheets 76 are shown positioned in the container 10. Each glass sheet 76 rests on its bottom (or top) edge on the bottom supports 74, and is held approximately upright in the container 10. The backmost glass sheet 76 is preferably positioned against the support surface 56 of the cradle portion 54.

As is evident in FIG. 6, the glass sheets 76 (in this case windshields for automobiles) are arcuate or curved. As described above, the contour of the supporting surface 56 is designed to mate with the curvature of the glass sheets 76. The glass sheets 76 are shown as having a concave curvature contacting a convex cradle support surface 56; however, the container can be configured so that the sheets 76 can be facing the other way where the convex side of the sheet 76 contacts a concave supporting surface 56.

FIG. 6 also shows a top portion 78 having a plurality of openings 80. The openings are separated by a segmented top wall 82.

An alternative embodiment of the container is shown in FIG. 7. In this embodiment, the top of the container 10 is formed from a first segment or flap 84 integrally connected as part of the front portion 12, and second segment or flap 86 integrally connected to the rear portion 42 of the container 10. The flaps 84,86 collectively form a top wall for the container 10.

The flaps 84,86 include an indent or cutaway portion 88 that forms an opening in the top wall. This allows for easy visual inspection of the contents of the container 10.

FIG. 7 also illustrates how the front portion 12 can pivot to open and close the container 10. In this embodiment, the front portion 12 has similar dimensions as the rear portion 42 of the container.

In yet another alternative embodiment of the present invention, the container can include a single floor support 90 as illustrated in FIG. 8. The floor support 90 extends along substantially the entire upper portion of the pallet 30. The floor support 90 includes two tabs 92 that extend outwardly beyond the front portion of the pallet 30 which can be used to connect the floor support 90 to the front portion 12 of the container. Similarly, tabs extending from the back of the floor support can be used to connect the floor support 90 to the rear portion 42 of the container. The floor support 90 includes cutaway portions 94 positioned to accommodate components of an alternative embodiment of the cradle.

Figure 9:
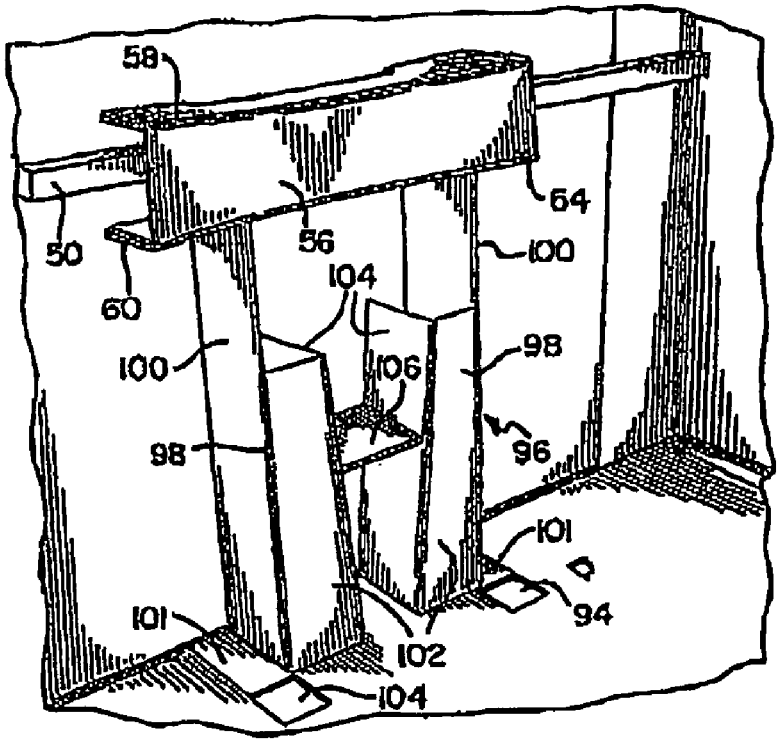
FIG. 9 is a perspective view of an alternative embodiment of the cradle portion.

FIG. 9 shows an alternative cradle 96. In this embodiment, the cradle portion 54 is supported by two support portions 98. The support portions 98 include a side panel 100 which extends from the bottom portion 28 of the container to the cradle portion 54. The bottom of the side panel 100 includes a flap 101 that is secured in the opening 94 in the bottom support 90. The lower two thirds of the support portion includes a front panel 102 integrally connected to the side panel 100 at one side, and an inner panel 104 integrally connected to the front panel 102 at its other side. A horizontal brace support 106 is fitted between the inner panels 104 of the support portions 98. The inner panels 104 can be provided with one or more slots to accommodate the brace support 106, or tabs extending from the brace support 106. Similarly, the back portion can also be provided with slots to accommodate the brace support 106 or tabs extending from the support.

Figure 10:
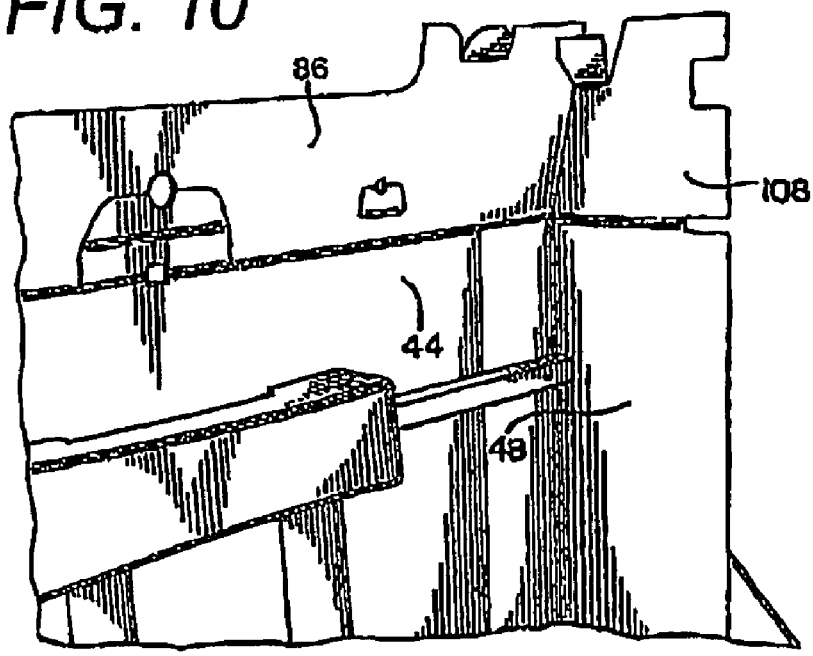
FIG. 10 is a perspective view of the interior side of a back portion of the container with an integral top portion.

FIG. 10 illustrates a top flap 86 extending from the back wall 44. Additionally, the side wall 48 can also include a flap 108 extending from the top of the side wall which can be used to form part of the top of the container. The opposing side wall 46 of the rear portion 42 and the side walls of the front portion 12 can also include flaps for use in the top portion.

Figure 11:
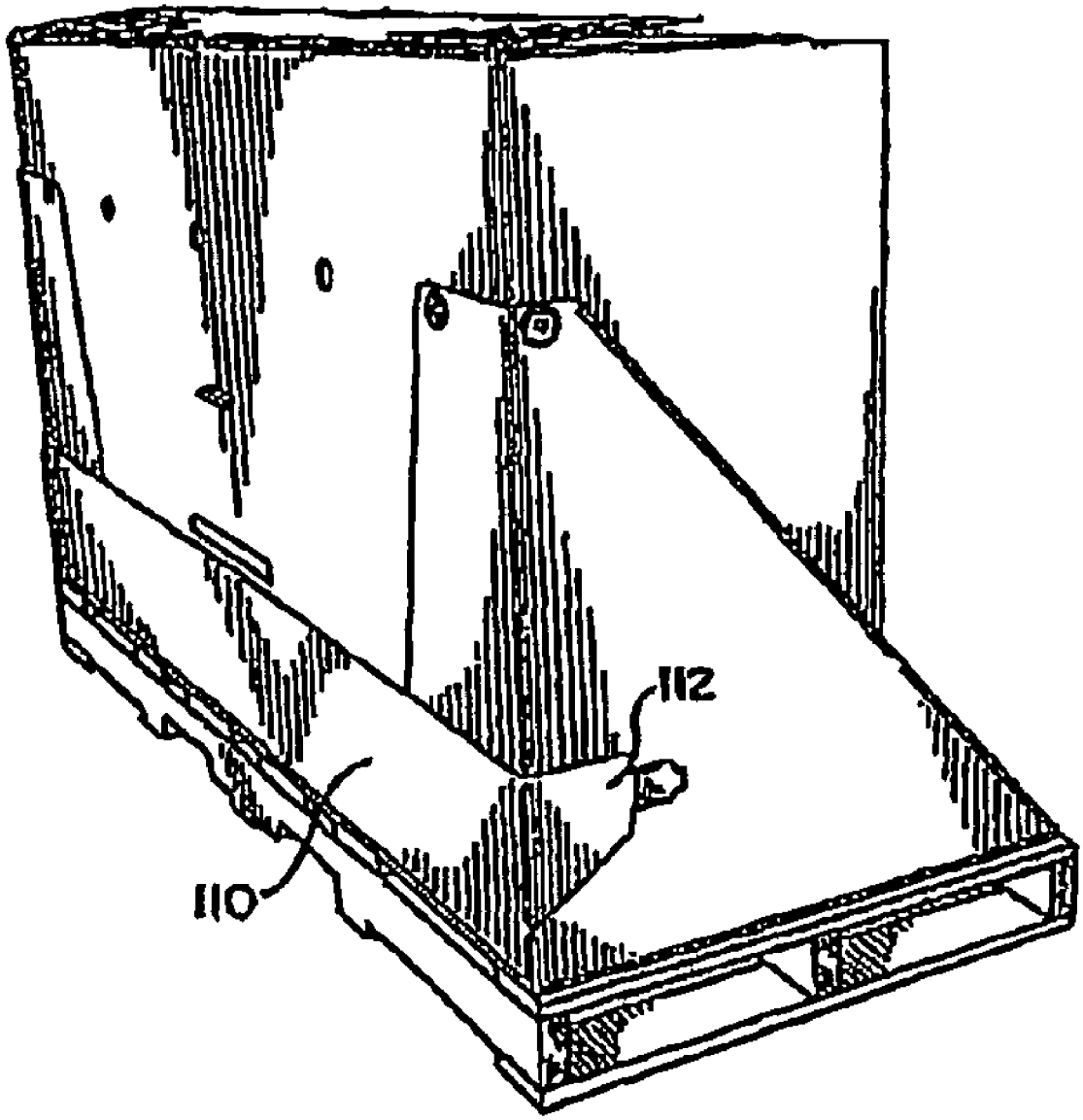
FIG. 11 is an exterior view of the back portion of the container.

Additional support can also be provided to the rear portion 42 of the container. As illustrated in FIG. 9 and FIG. 11, a lower back panel 110 spans from one side of the back of the container to the other side proximate the bottom of the container. The lower back panel 110 includes flaps 112 to facilitate connection to the side support portions 38 of the corner portions 36.

In accordance with one embodiment of the invention, a banding system 120 is utilized to secure the glass sheets 76 internally in the container 10 as shown in FIGS. 12-16. The banding system 120 comprises a band support structure that includes a generally horizontal, central support member (or top band support) 122, and a generally vertical post 123 positioned in front of the glass sheets. The central support member 122 extends from an upper, mid-portion of the back wall 44 into the interior of the container 10. The vertical post 123 (sometimes referred to as the front lash board) extends from a bottom portion 28 of the container to the central support member 122, and is positioned in front (i.e., toward the front of the container) of the plurality of glass sheets 76. The vertical post 123 can be formed from wood. A band is positioned around the central support member 122, vertical post 123, bottom portion 28 of the container and the back wall 44 of the container, to securely hold the glass sheets in place in the container 10.

The central support member 122 can be formed from a corrugated material, such as cardboard; however, plastic or other materials can be used. In the embodiment shown in FIGS. 12 and 13, the central support member 122 is formed from a single corrugated blank. The corrugated blank is folded into a generally rectangular shape having a plurality of layers (which can be seen at the end of the central support member 122). A front lock tab or flap 124 is folded downward into an inset 126 formed in the folded blank to hold the folded layers together. Similarly, a back lock tab or flap 128 is also folded downward into a back inset 130 to hold the layers together. Glue or other binding means can also be used to hold the layers together and maintain the blank in the rectangular configuration. The back lock tab 128 also includes a band guide slot 132 for the purpose described below. The multiple layers of the central support member 122 provide the support member 122 with sufficient strength to withstand the banding pressures applied to it.

Figure 14A:
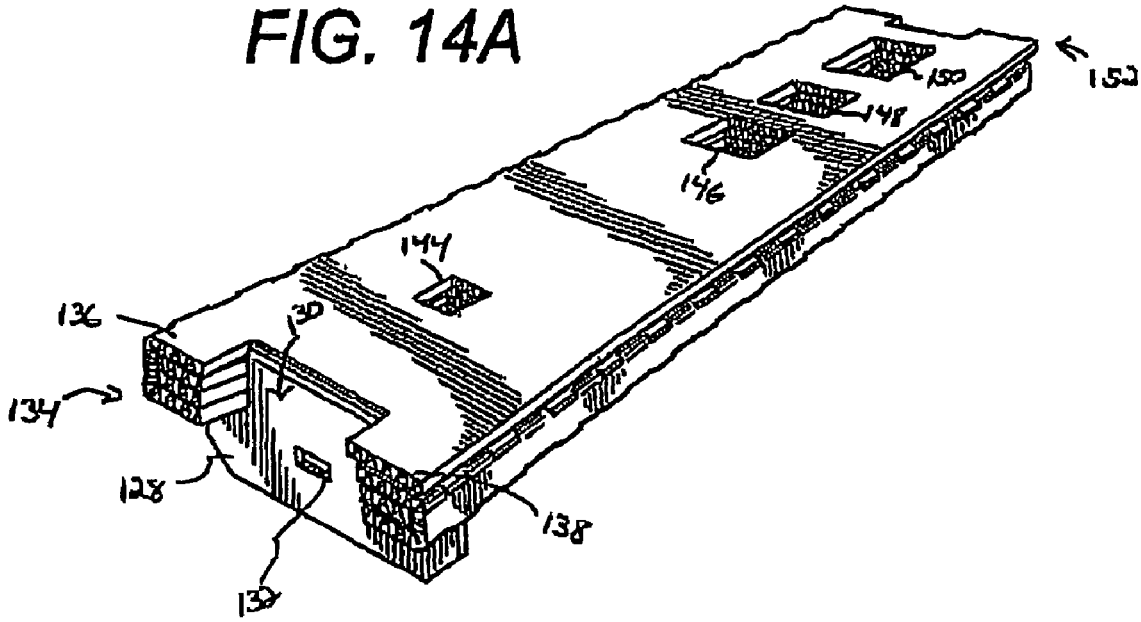
FIG. 14A is a perspective view of the top of the central support member of the banding system shown in FIG. 12.
Figure 14B:
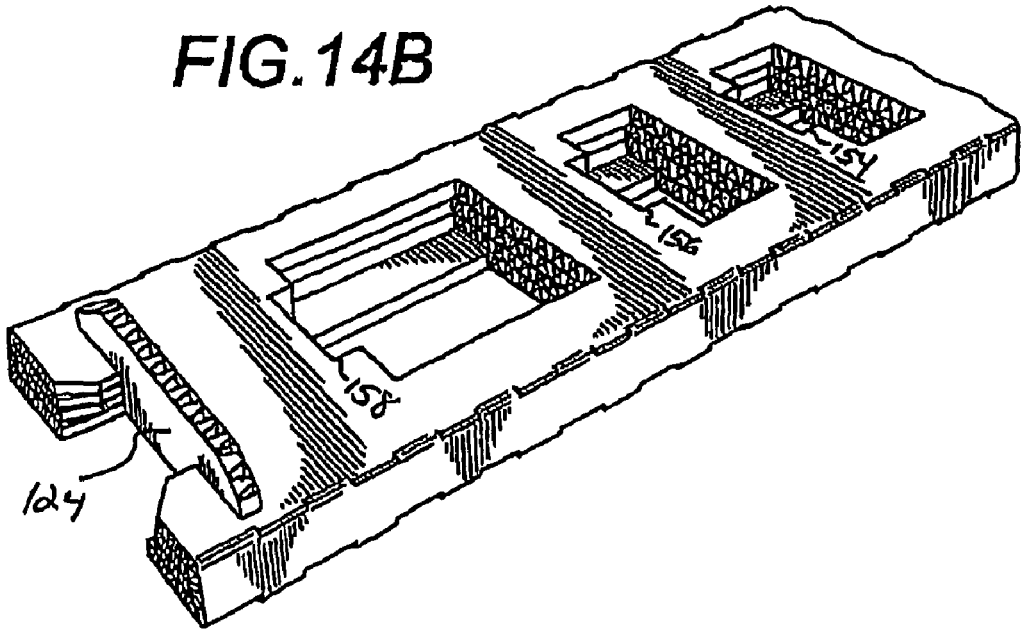
FIG. 14B is a partial perspective view of the bottom of the front end of the central support member of the banding system shown in FIG. 12.
Figure 15:
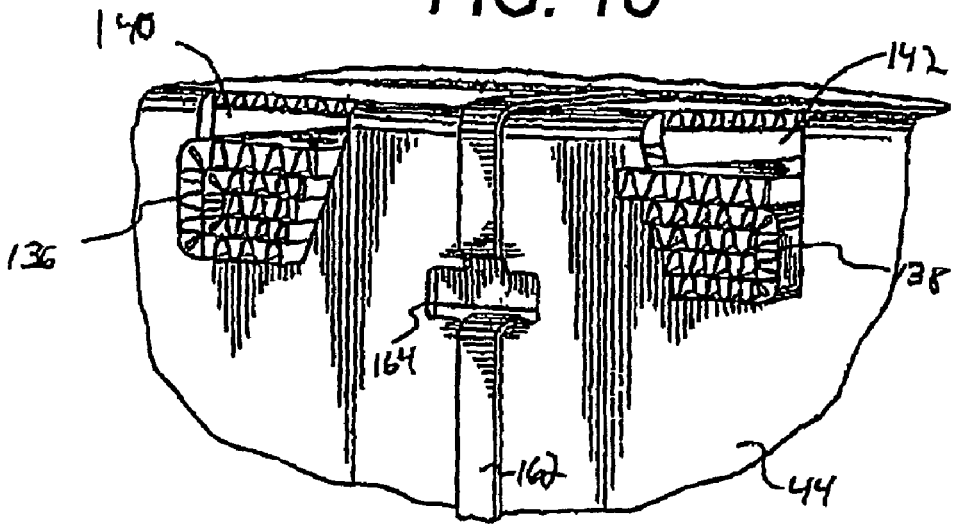
FIG. 15 is a perspective view of a back wall of the banding system.

The central support member 122 has a first or back end 134 which is configured to be positioned against the back wall 44. As shown in FIG. 14, the back lock tab 128 is folded into the inset 130 formed in the layers of the blank to create a first projection 136 at one side of the first end 134 and a second projection 138 at an opposing side of the first end 134. The first and second projections 136, 138 fit into first and second mounting openings 140, 142 in the back wall 44 as shown in FIG. 15.

The central support member 122 also includes a plurality of openings that extend from the top of the central support member 122 through to the bottom of the central support member 122. The openings extend through each of the layers of the central support member 122.

A first square opening 144 is positioned proximate the first end 134 of the central support member 122. In the embodiment shown, the first opening 144 is approximately four and ½ inches from the first end 134. The first opening 144 along with the slot 132 in the back lock tab 128 are utilized to secure or anchor the central support member 122 to the back wall 44 as described below.

The central support member 122 also includes second, third and fourth openings 146, 148 and 150 positioned progressively toward a second or front end 152 of the central support member 122. Again, each opening extends from the top of the central support member 122 through each of the layers to the bottom of the central support member 122. Referring to FIG. 14B, looking at the bottom of the central support member 122, each of the openings 146, 148 and 150 is generally rectangular with a smaller rectangular notch 154, 156 and 158 extending toward the second end 152.

The second, third and fourth openings 154, 156 and 158 are utilized to support a band close to the last glass sheet 76 of the plurality of sheets 76 stacked against the back wall 44. The multiple openings allow the system 120 to be easily adjusted to accommodate the particular number of sheets 76 shipped in a container 10. In this regard, more or fewer openings can be utilized depending on the size of the container and the amount of adjustability desired.

The vertical post 123 extends from the bottom portion 28 of the container 10 to the central support member 122. Cardboard 160 or other suitable materials or dunnage can be inserted between the post 123 and a frontmost glass sheet 76 of the plurality of glass sheets 76 positioned in the container 10, to prevent the post 123 from scratching or otherwise damaging this glass sheet 76 during shipping.

The back wall 44, central support member 122, vertical post 123 and the bottom portion 28 of the container 10, are utilized to support a band 162. The band 162 performs the dual function of securing the central support member 122 to the back wall 44, and holding the vertical post 123 against the plurality of glass sheets 76. In this manner, the glass sheets 76 are securely maintained in the container during transport.

Referring to FIGS. 12, 13A, 13B and 15, the band 162 is inserted through a slot 164 in the back wall 44 (between the mounting openings 140 and 142) into the interior of the container 10. The band 162 is then routed through the guide slot 132 in the back lock tab 128 and through the mounting opening 144 from the bottom to the top of the central support member 122. The band 162 is then looped back toward the back wall 44 and into a channel 166 formed between the back lock tab 128 and the back wall 44 between the projections 136 and 138.

The band 162 is then routed back through the slot 164 in the back wall 44 and upward toward the top of the container 10. Alternatively, the band 162 can pass through a second slot in the back wall instead of the same slot 164 it entered. In such an embodiment, a second slot can be provided in the back wall 44 for this purpose.

Figure 16:
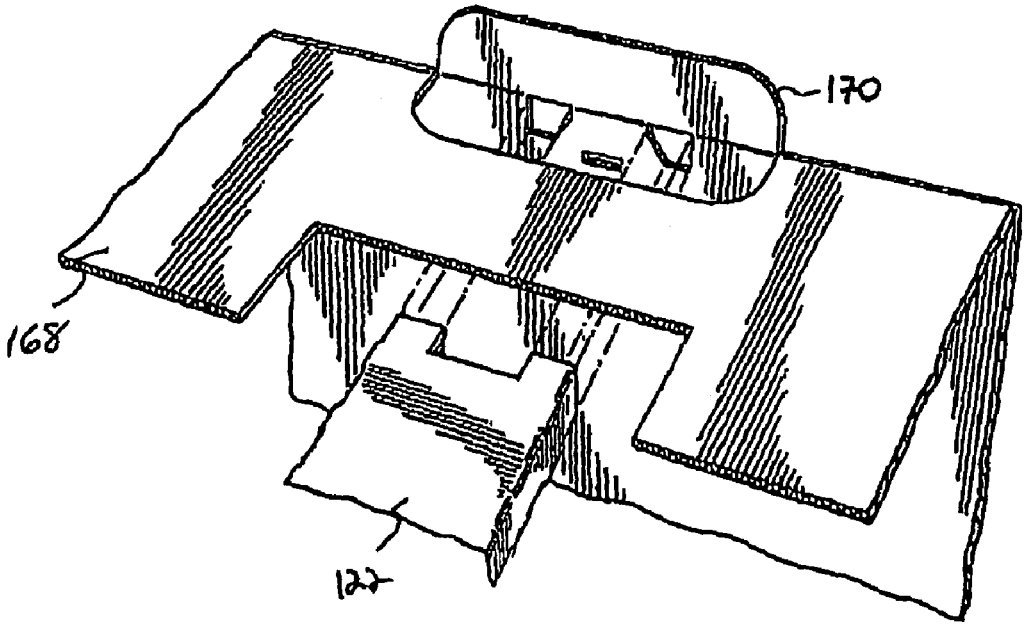
FIG. 16 is a perspective partially exploded view of the central support member and the back wall of the banding system; and, FIG. 17 is a perspective view of a banding system for securing glass sheets in the container in accordance with another embodiment of the invention.

In the embodiment shown in FIG. 16, a top flap 168 extends from the top of the back wall 44 and is used to form part of the top of the container 10 (a similar flap can extend from the front wall of the container to complete the top of the container). The top flap 168 includes a center fold down panel 170 positioned above the mounting openings 140, 142. The band 162 can be passed through the center fold down panel 170 and back into the interior of the container 10 to the central support member 122. Alternatively, if the top flap does not extend too far toward the front of the container, the band 162 can be passed over the entire top flap 168 and back to the central support member 122.

Figure 12:
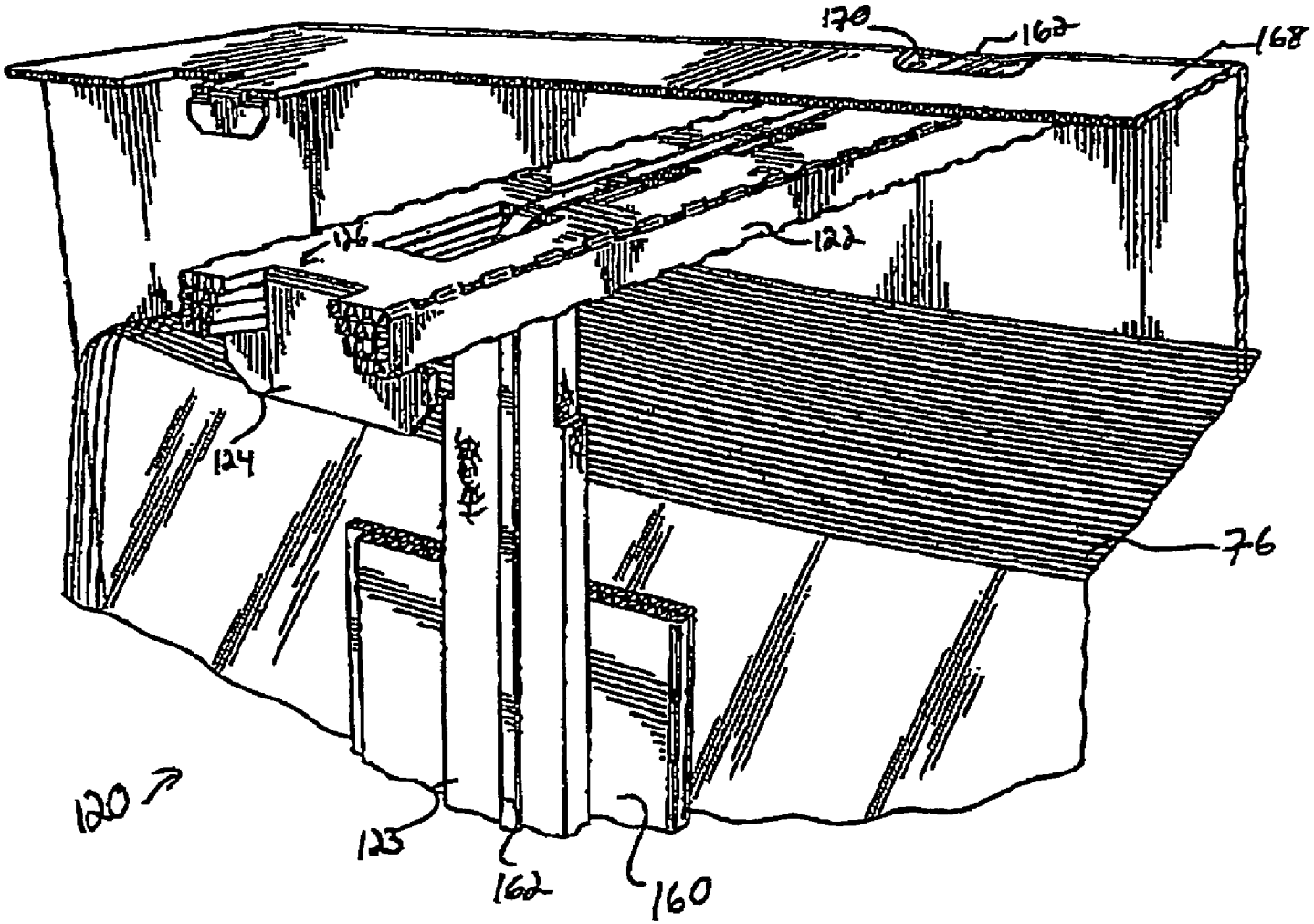
FIG. 12 is a perspective view of a banding system for securing glass sheets in the container in accordance with an embodiment of the invention.
Figure 13A:
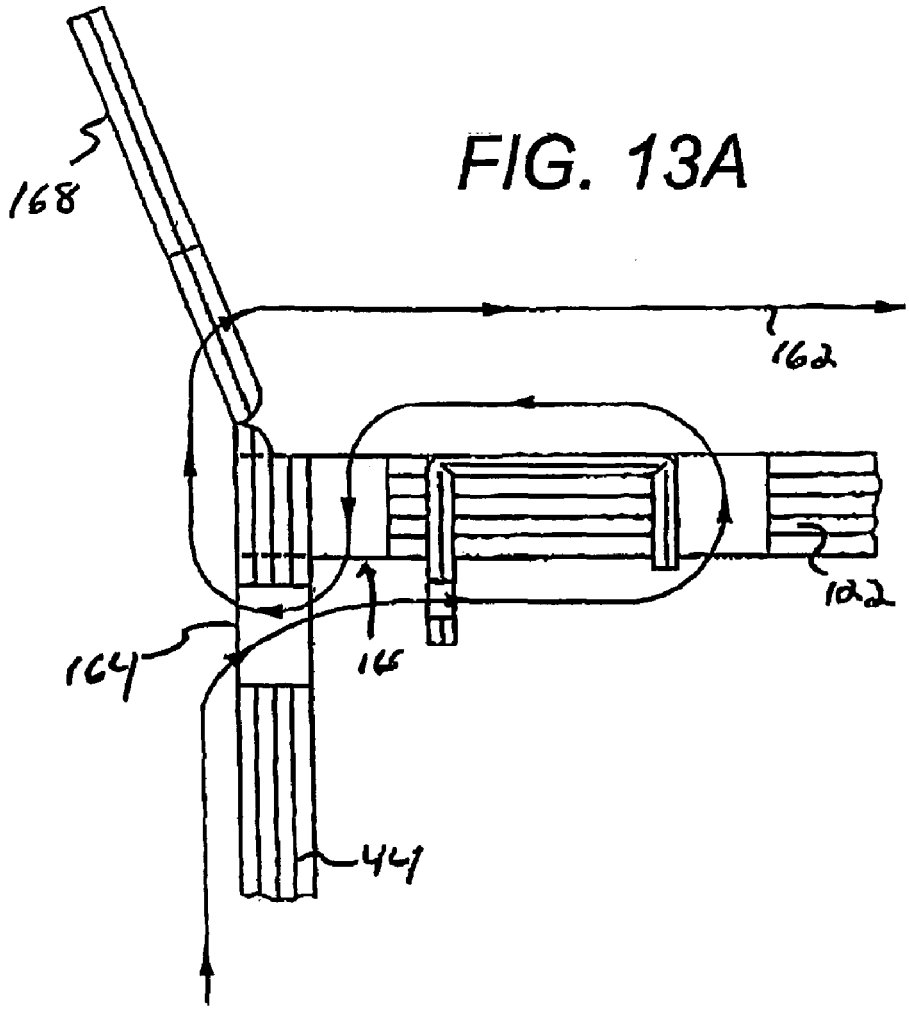
FIG. 13A is a partial cross-sectional view illustrating the routing of the band in the system of FIG. 12 through the back end of the central support member.
Figure 13B:
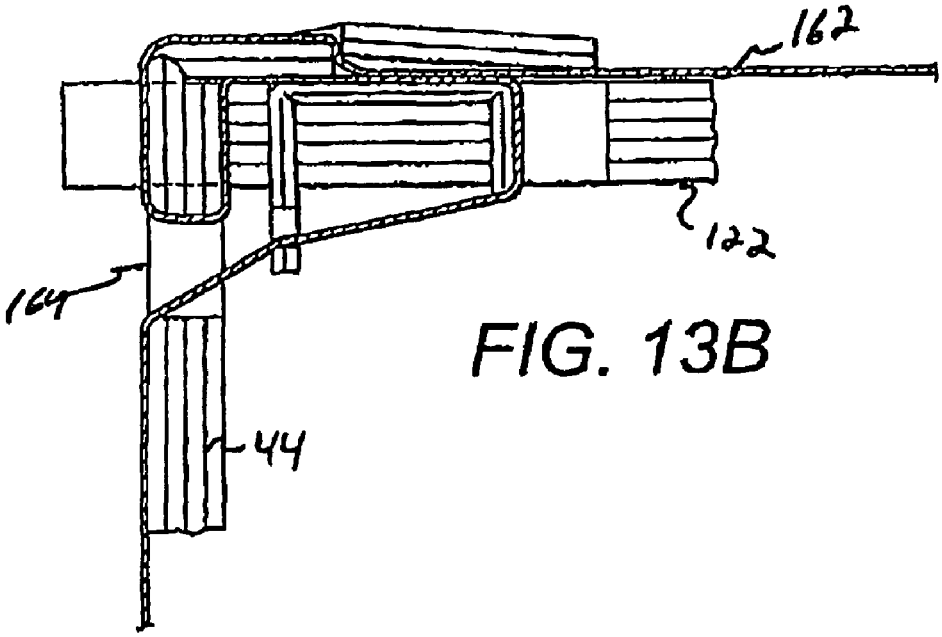
FIG. 13B is the partial cross-sectional view of FIG. 13A with the band in place.

As illustrated in FIG. 12, the band 162 passes through an appropriate opening in the central support member 122 (in this case the opening 150 closest to the second end 152 of the central support member 122). The band is then passed in front of the vertical post 123 down toward the bottom portion 28 of the container 10. The band 162 is then passed through an opening in the bottom portion 28 and back toward the back of the container 10 to complete a circuit.

The band 162 is then tightened and secured to itself in a conventional manner. When the band 162 is tightened, it causes the vertical post 123 to securely maintain the plurality of glass sheets 76 in position against the back wall 44. Additionally, because the band 162 is threaded through the opening 144 proximate the back end of the central support member 122, it forces the central support member 122 to press against the back wall 44 (keeping the projections 136, 138 on the back end 134 of the central support member 122, securely fixed in the first and second mounting holes 140, 142 in the back wall 44), and securely maintains the central support member 122 in place.

Figure 17:
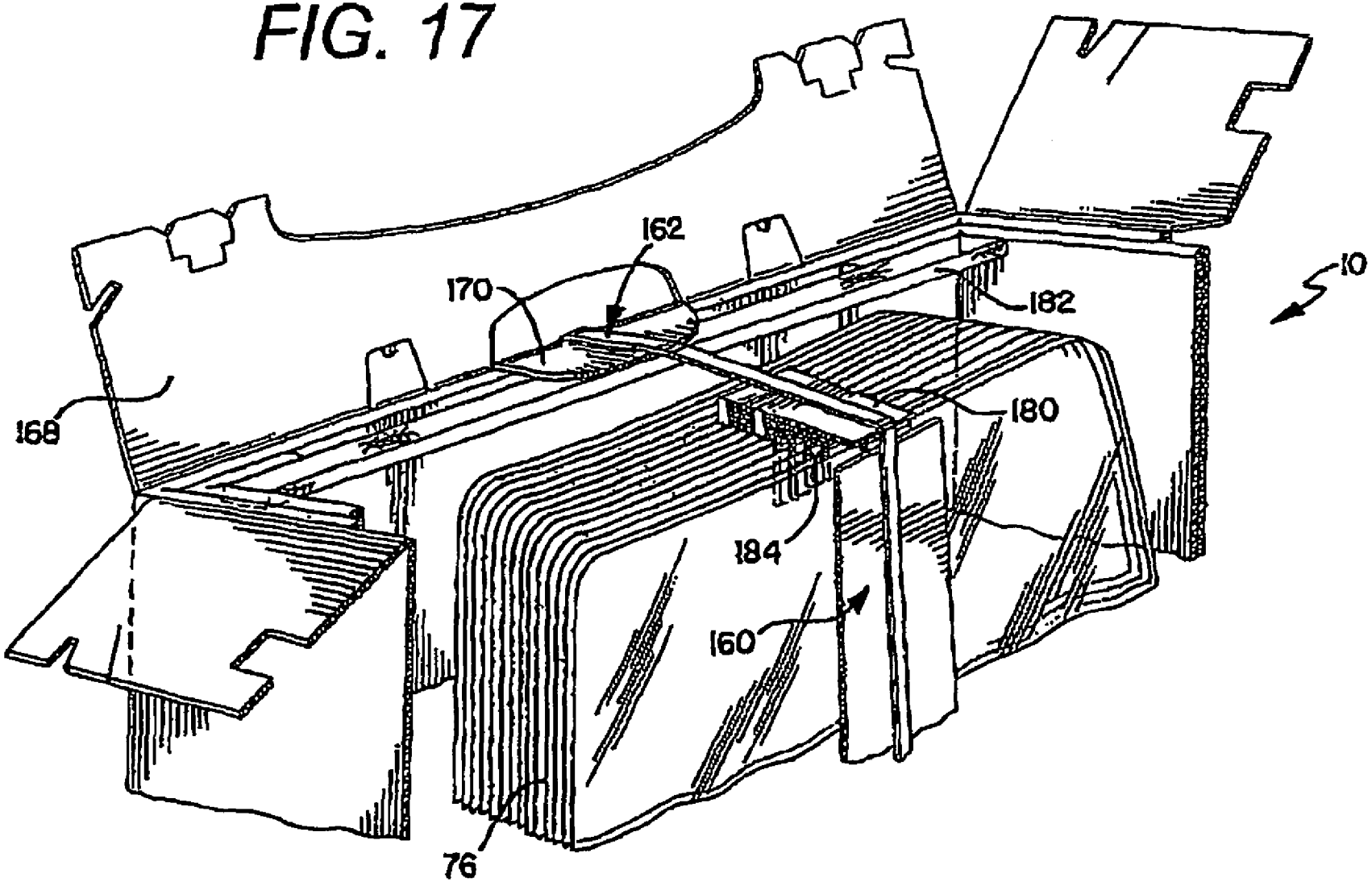
Figure 18:
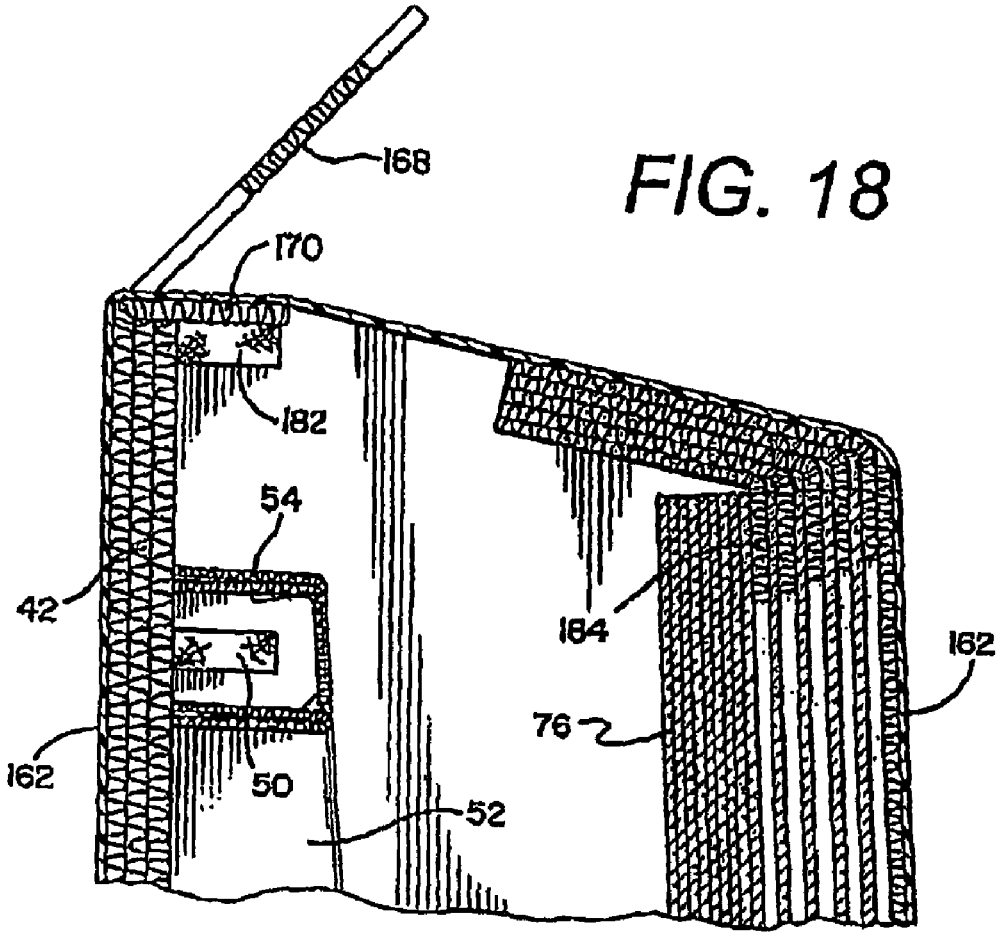
FIG. 18 is a cross-sectional view of the banding system and container of FIG. 17.
Figure 19:
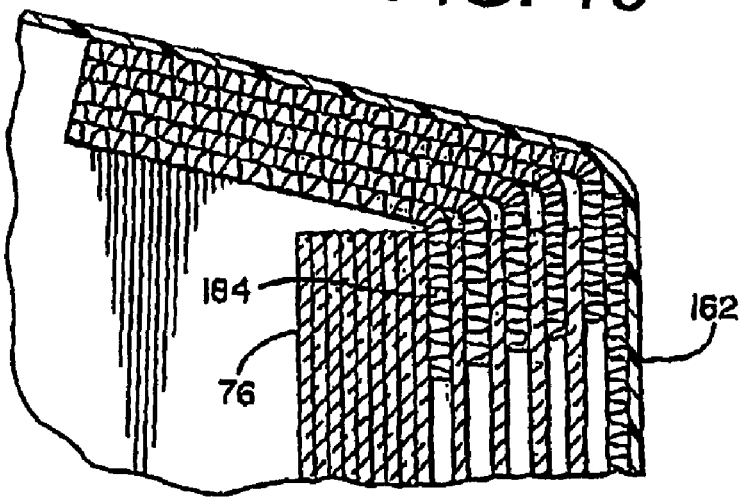
FIG. 19 is a close up view of a portion of the banding system shown in the cross-sectional view of FIG. 18.

FIGS. 17-19 show another embodiment of the banding system of the present invention. Instead of utilizing a central support member positioned above the tops of the glass sheets 76 such that the support member does not come into contact with the glass sheets 76, the system shown in FIGS. 17-19 includes an upper support member 180 designed to rest on or be supported by the tops of the glass sheets 76. In the preferred embodiment shown, the upper support member 180 is positioned proximate the front of the stack of glass sheets 76 and does not extend to the back wall 44. In this manner, the system is adjustable for use with varying numbers of glass sheets which may be placed in the container 10.

As shown in FIG. 18, the container 10 includes the cradle 52 and a wood support beam 50 extending horizontally along the back wall 44. The banding system in this embodiment also utilizes an upper wood beam 182 extending across the back wall 44 proximate the top of the wall 44. The upper wood beam 182 supports the fold down panel 170 and band 162 during use.

The upper support member 180 includes a plurality of separators 184, i.e., extensions or flaps, extending downward from the upper support member 180. The separators 184 are positioned between adjacent glass sheets toward the front of the plurality of glass sheets 76. The separators 184 fill the space between the glass sheets 76. In this manner, the separators 184 reduce or eliminate a potential pressure point on the top edge of the glass sheets 76 when used with the banding system of this embodiment. The frontmost separator 184 is positioned to cover a portion of the frontmost glass sheet 76 and is not used to actually separate two adjacent glass sheets.

In operation, the banding system of FIGS. 17-19 includes a band 162 which is threaded along the back wall 44 and through the fold down panel 170 in the top flap 168. The band extends over the top of the glass sheets 76 to the upper support member 180, down the front of the glass sheets 76, and through the bottom of the container to loop back to the back wall 44. The cardboard 160 (or other suitable materials or dunnage) positioned at the front of the stack of glass sheets 160 can be utilized to prevent the band 162 from contacting and scratching the frontmost glass sheet 76. The band 162 is tightened to securely hold the glass sheets 76 in place during transit.

While the band 162 is shown going through the opening created by the fold down panel 170 in the top flap 168, the band 162 can alternatively go over the entire flap 168 (especially for flaps not having a fold down panel) or through a slot or other cutaway portion in the top flap 168. If a separate cover piece or top is utilized with the container instead of the flap 168 (and a corresponding flap from a front wall), the band 162 can go over the top of the back wall 44 directly onto the wood beam 182 or via a slot or fold down panel in the separate cover piece.

Figure 20:
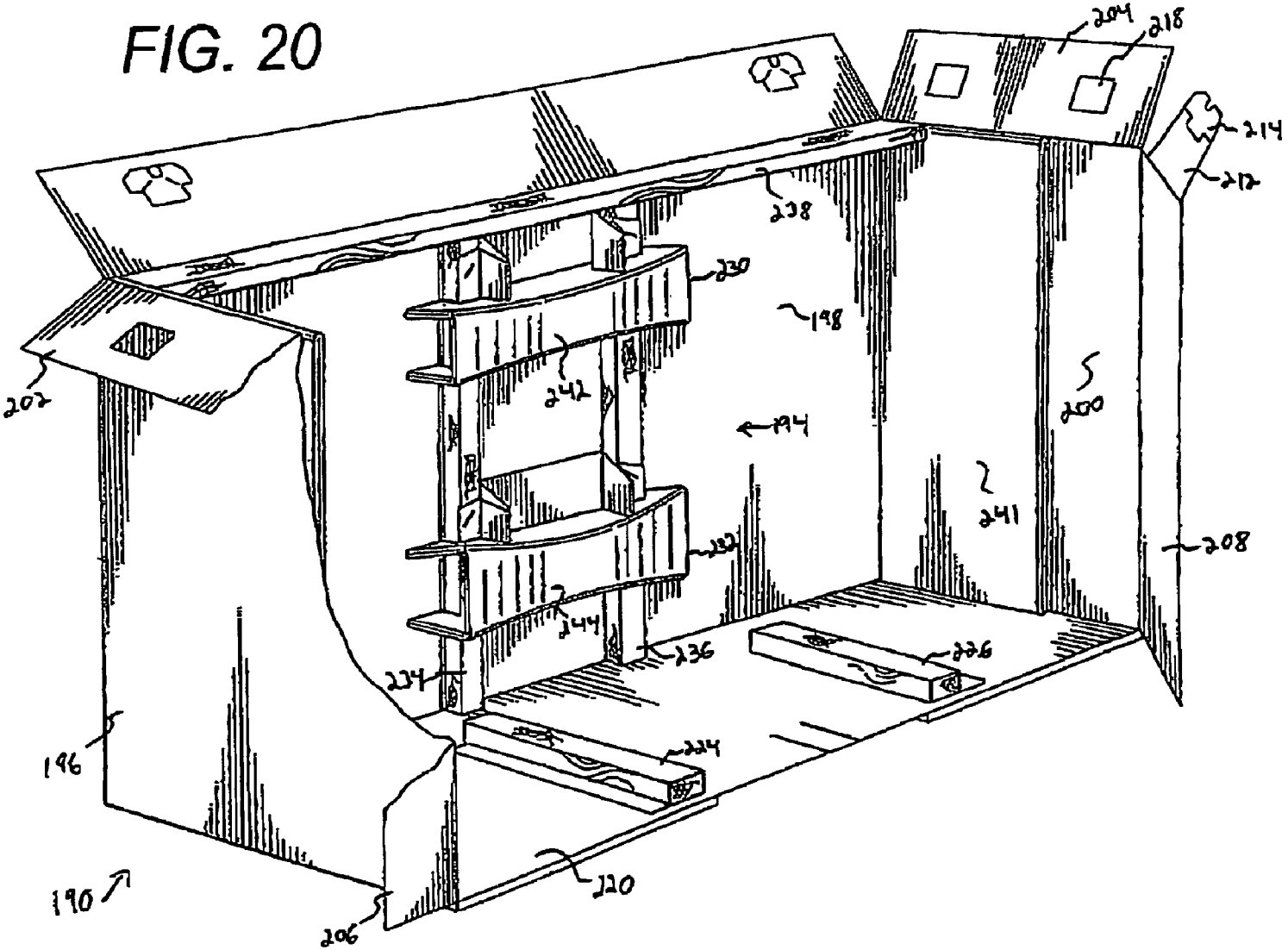
FIG. 20 is a perspective view of back portion of a container in accordance with another embodiment of the present invention.

A back section 190 and a front section 192 of an alternative embodiment of a container for transporting glass sheets 76 are shown in FIGS. 20 and 21, respectively. The container includes an alternative "double" cradle structure 194 for supporting the glass sheets 76.

The back section 190 includes a first outer side wall 196 integrally formed with or connected to a back wall 198 and an opposing second outer side wall 200 integrally formed with or connected to the back wall (i.e., the back wall and side walls can be formed from a single corrugated blank wherein the side walls are formed by folds in the blank, additional layers of corrugated material, or other suitable material may be laminated onto the blank). The first outer side wall 196 is shown partially cut away to facilitate viewing of internal features of the container. However, the first outer side wall 196 (including features attached thereto described below) is preferably a mirror image of the second outer side wall 200 shown in FIG. 20. The back section 190 also includes a first inner side wall structure 240 (see FIG. 22) proximate the first outer side wall 196 and a second inner side wall structure 241 proximate the second outer side wall 200. The inner side wall structures 240, 241 do not need to extend the entire width of the container (i.e., that is, the inner side wall structures 240, 241 do not extend as far as the outer side walls 196, 200). The inner side wall structures 240, 241 provide reinforcement for the container and act as stops for corresponding structure in the front section 192. The inner side wall structures 240, 241 may also be laminated to the outer side walls 196, 200.

Each of the first and second side walls 196, 200 includes a top flap or panel 202, 204 integrally formed with and extending from a top portion or edge of each side wall 196, 200. The top flaps or panels 202, 204 can be folded over to form a portion of a top of the container.

A front flap or panel 206, 208 is integrally formed with and connected to each side wall 196, 200 along a front side edge of each side wall 196, 200. The front flaps or panels 206, 208 include a top flap or panel 210 (see also FIG. 23), 212 having a tab 214 configured to mate with an opening 216, 218 in the top flaps or panels 202, 204 of the side walls 196, 200.

The back section 190 includes a bottom wall portion 220 that is connected to or formed from a pallet structure 222. A first support 224 for the glass sheets and a second support 226 for the glass sheets are secured to the bottom wall portion 220. The glass sheet supports 224, 226 can be formed from a corrugated material, wood, or some other suitable material. More than two supports can be utilized depending on the size or number of the glass sheets being transported.

The back section 190 includes the "double" cradle structure 194 positioned against the back wall 198. The cradle structure 194 is designed to contact and support a stack of glass sheets 76 having a curvature, such as automotive windshields, placed in the container. The glass sheets 76 are stacked on an edge (which rest on and are supported by the glass sheet supports 224, 226) so that only the backmost sheet contacts the cradle structure 194.

The cradle structure 194 includes a first or top cradle portion 230 and a second or bottom cradle portion 232 spaced from the top cradle portion 230 (depending on the size of the container and the glass sheets being transported, the cradle structure can include additional cradle portions between the top and bottom cradle portions). The top cradle portion 230 is positioned to contact a portion of the backmost glass sheet 76 proximate the top or top half of the glass sheet 76, and the bottom cradle portion 232 is positioned to contact a portion of the backmost glass sheet 76 proximate the bottom or bottom half of the sheet.

The cradle portions 230, 232 are centered about a first vertical brace 234 and a second vertical brace 236. The vertical braces 234, 236 extend from the bottom wall portion 230 to a horizontal brace 238. The horizontal brace 238 spans the back wall 198 from the first side wall 196 to the second side wall 200. Both the vertical braces 234, 236 and the horizontal brace 238 can be wood beams or other suitable materials.

The vertical braces 234, 236 support the horizontal brace 238 proximate the top edge of the back wall 198 of the back section 190. Loads encountered by the horizontal brace 238 (e.g., from stacking one container upon another) are transferred through the vertical braces 234, 236 to the bottom pallet 222. Similarly, loads on the vertical braces 234, 236 are transferred to the horizontal brace and bottom portion to the corners of the back section 190. This construction prevents bowing of the container.

Additional braces can be used for extra support as necessary. For example, additional vertical braces can be placed in the corners of the back section 190 proximate the side walls 196, 200. Also, additional horizontal braces can be utilized along the back wall 198. The braces can be stapled, nailed or otherwise secured to the back wall 198 of the back section 190.

Similar to the cradle portion 54 shown in the embodiment of FIGS. 1-11, the top and bottom cradle portions 230, 232 each include a front facing cradle support surface or leading surface 242, 244. The front facing cradle support surfaces 242, 244 are slightly curved to have a convex outer surface to match the curvature of the glass sheets 76 which presents a concave surface for abutting the cradle portions 230, 232 (the opposing sides of the glass sheets having a convex surface). The cradle portions 230, 232 are preferably formed from a corrugated material. The corrugated material can be folded over as necessary to obtain the required strength for use with the glass sheets 76 (i.e., depending on the size and number of such sheets).

In practice, the plurality of glass sheets 76 are positioned to lean against and be supported by the cradle structure 194. To better accommodate this, the bottom cradle portion 232 is designed to extend outward from the back wall 198 farther into the interior of the container than the top cradle portion 230 (see also FIGS. 26 and 27). This creates, in effect, a slanted support surface structure (preferably exhibiting about a five degree slant from the vertical). Any intermediate cradle portions that may be added between the top and bottom cradle portions 230, 232 should be distanced accordingly to fall between the bottom and top cradle portions 230, 232 and maintain the same angle.

Figure 23:
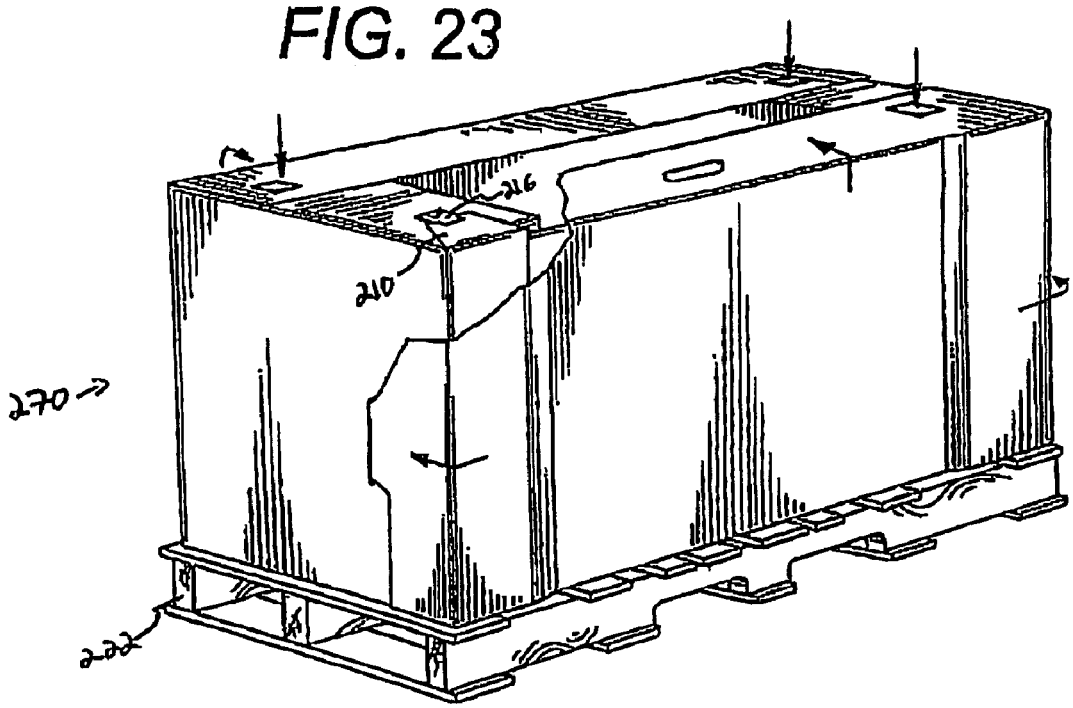
FIG. 23 is a perspective view of the container of FIG. 22 with the locking mechanism in a closed position.

The front section 192 of the container includes a front wall 250 integrally connected to a top flap 252 along a top edge. Additionally, the front wall 250 is a first inner side wall 254 along a first side edge and a second inner side wall 256 along a second side edge. Referring to FIGS. 22-23, the front section 192 also can include a first outer side wall 264 and a second outer side wall 266.

The inner side walls 254, 256 of the front section 192 are designed to fit inside of the outer side walls 196, 200 of the back section 190 along the same respective planes as the inner side walls 240, 241 of the back section 190. The inner side walls 254, 256 are sized to compliment the inner side walls 240, 241 to form a substantially continuous inner wall structure in the completed container 270.

The outer side walls 264, 266 of the front section 192 wrap around the front flaps 206, 208 of the back section 190. The outer side walls 264, 266 of the front section 192 include a tab 272, 274 that correspond with slots 276 (only the left side slot is visible in the Figures) in the outer side walls of the back section 190. These may be used to interlock the two components together. FIG. 23 shows the container substantially closed and ready for transport.

Portions (or all) of the back section can be laminated (i.e., wherein one or more sheets of corrugated or other material are glued together). For example, the inner side walls 240, 241 may be laminated to the outer side walls 196, 200. Another sheet can be laminated to the back wall 198.

The interior of the front section 192 includes a first vertical brace 258 and a second vertical brace 260 positioned along the front wall 250 proximate the side walls 254, 256, respectively. The vertical braces 258, 260 extend from the bottom of the front wall 250 to a horizontal brace 262 positioned proximate the top of the front wall 250 (FIG. 21). The braces can be stapled, nailed or otherwise secured to the front wall 250. Again, additional braces can be added as necessary depending on the size of the container or strength requirements needed.

Taking advantage of the curvature of the sheets of glass, it is possible to cut down on material costs of the container. Referring to the embodiment of FIGS. 24 and 25, a modified container 280 having a back section 282 and front section 284 is shown.

The back section 282 includes a first outer side wall 286 and a second outer side wall 288 extending from opposing edges of a back wall 290. The outer side walls 286, 288 include either a tab (or opening) 292 that can be used to interlock with an opening (or tab) 294 on the front section 284.

The back section 282 also includes a first inner side wall 296 and a second inner side wall 298. The inner side walls 296, 298 are each integrally connected to an angled front corner section 300, 302, which is further integrally connected to a front locking section 304, 306. The front locking sections 304, 306 include a locking tab 308 (only one locking section is visible in FIG. 24) that cooperates with an opening 310 in a top panel 312 to interlock the front section to the top of the container.

The front section 284 includes a front wall 314, a first side wall 316 integrally connected to one side of the front wall 314 and an opposing second side wall 318 integrally connected to the other side of the front wall 314. Each of the side walls 316, 318 are connected to the front wall via a reinforcing corner section 320, 322.

Figure 24:
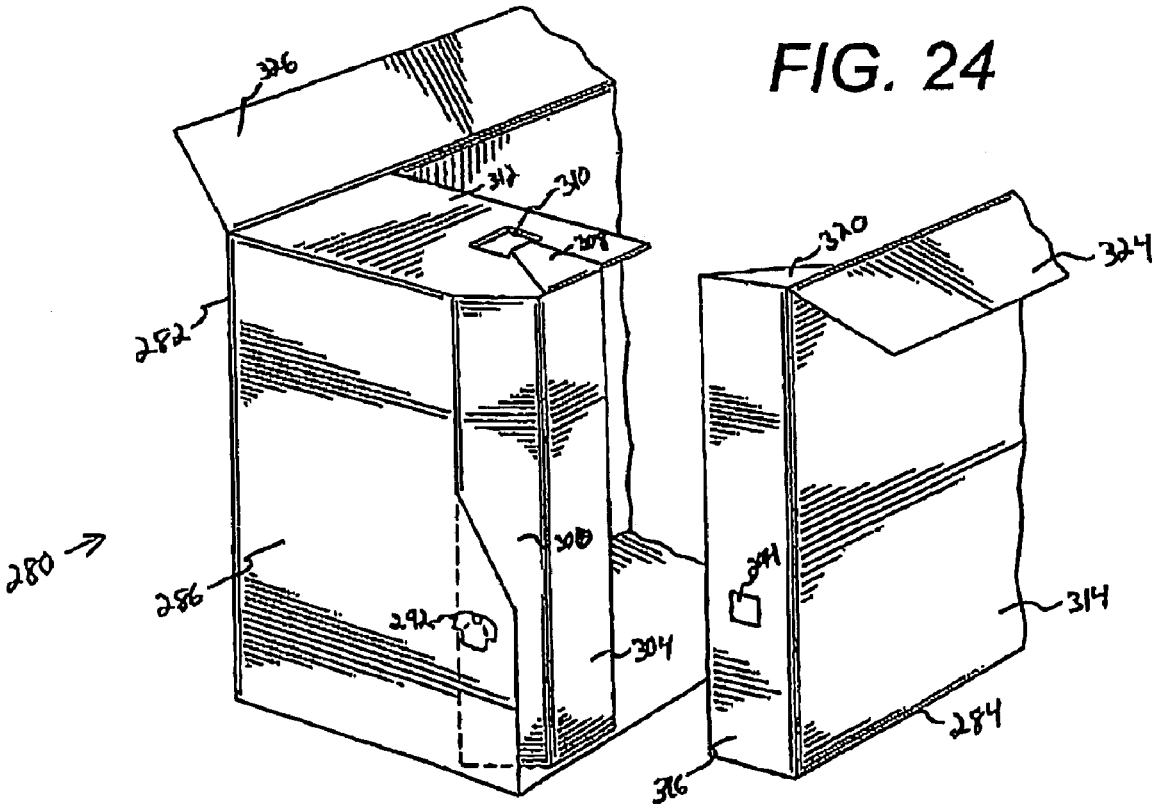
FIG. 24 is a perspective view of an alternative container with a chamfered corner portion.
Figure 25:
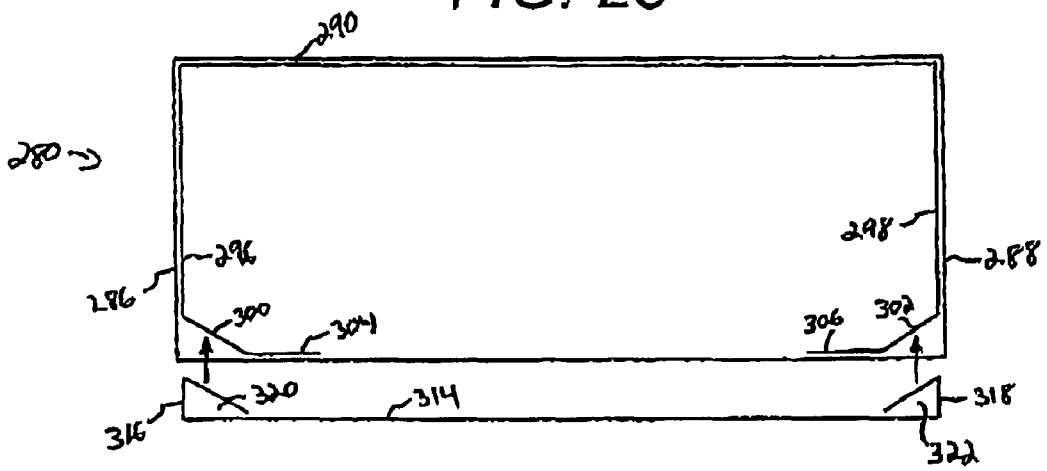
FIG. 25 is an illustration of a top plan view of the container of FIG. 24.

As evident in FIGS. 24 and 25, the front section 284 does not need to include vertical and horizontal braces of FIG. 21. This reduces the costs associated with manufacturing the container. Additionally, further cost savings can be achieved by only laminating the back wall. However, if cost is of little concern or additional strength is required, the braces can be utilized with this embodiment, and/or additional lamination may be utilized.

Both the front section 284 and the back section 282 include a top flap 324, 326 integrally connected to the top edge of the front wall 314 and back wall 290, respectively.

Figure 26:
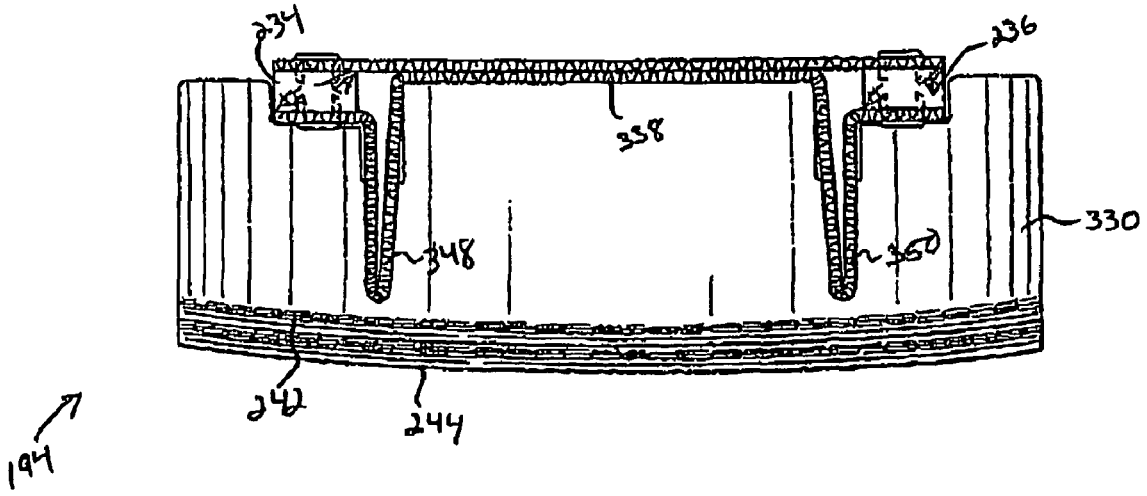
FIG. 26 is a top plan view of the cradle shown in FIG. 20.
Figure 27:
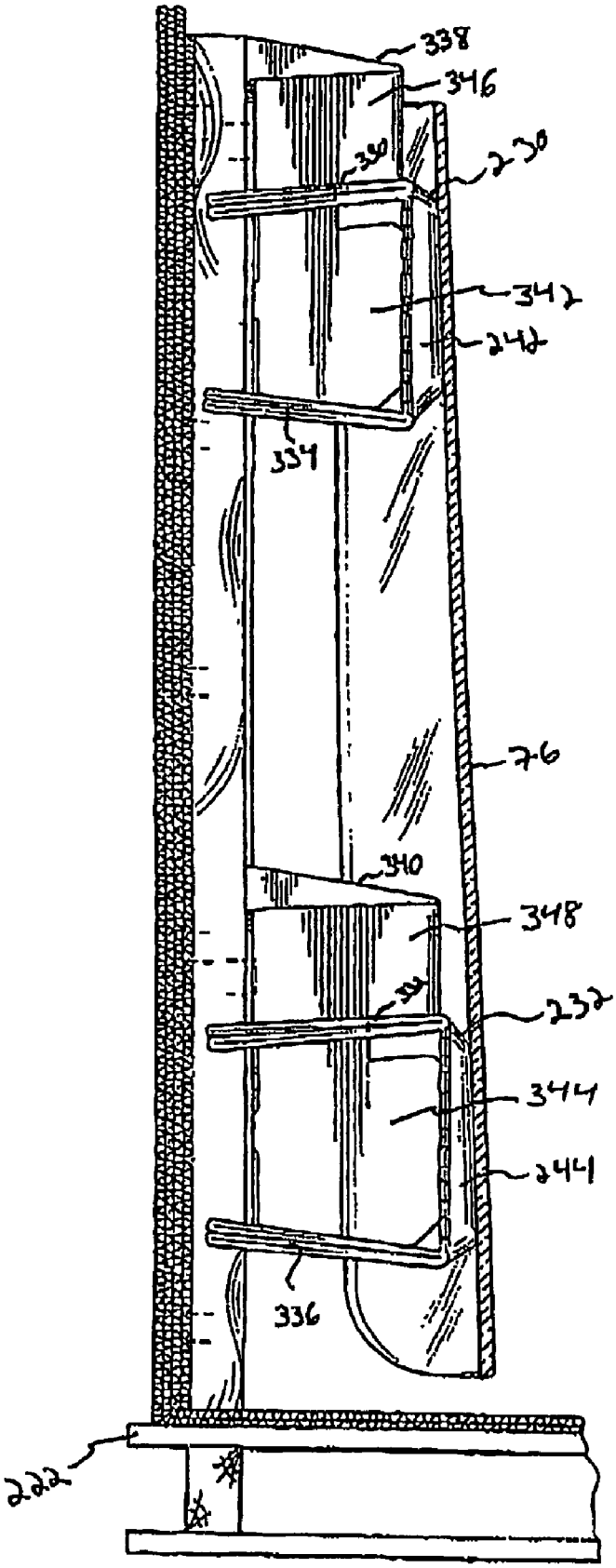
FIG. 27 is a cross-sectional view of the cradle of FIG. 20 and a windshield.

As shown in FIGS. 26 and 27, additional features of the cradle 194 are present. Specifically referring to FIG. 27, from a side perspective each cradle portion 230, 232 has a generally U-shaped structure (turned sideways). The structure includes a top panel 330, 332 which is integrally connected to the front surface 242, 244, and a bottom panel 334, 336.

Each of the cradle portions 230, 232 is connected to a support member 338, 340. A portion of each support member 338, 340 is utilized as an internal support 342, 344 that is positioned inside the U-shaped structure of the cradle portions 230, 232. Each support member 338, 340 also includes a top structure 344, 346. The support members 338, 340 are stapled to the vertical braces 234, 236.

Both the top structure 344, 346 and the internal support 342, 344 are configured to include a first stiffening projection 348 and a second stiffening projection 250. The projections are formed by folds in the support member 338, 340. Slots in the projections 348, 350 allow for insertion of the top panel 330, 332 of the cradle portions 230, 232, and separate the top structures 346, 348 from the internal supports 342, 344. The support members 338, 340 are preferably formed from a corrugated material.

FIGS. 26 and 27 also show the front surface 244 of the bottom cradle portion 232 extending a greater distance from the back wall 198 than the front surface 242 of the top cradle portion 230. This provides a slight slant or angle (from the perpendicular) toward the top of the back wall 198 as is evident in the glass sheet 76.

As used herein, directional or positional terms, such as front, back, top and bottom, are used to facilitate understanding of the invention with respect to the container and its components in the position shown in the Figures. These terms are not meant to limit the scope of the invention or require the container to be maintained in the upright position shown.

While the specific embodiments have been illustrated and described, numerous modifications come to mind without significantly departing from the spirit of the invention, and the scope of protection is only limited by the scope of the accompanying Claims.

What is claimed is:

1. A container for transporting glass sheets having a radius of curvature, the container comprising:

a bottom portion, a first side wall extending upward from a first side of the bottom portion, a second side wall extending upward from a second side of the bottom portion and a back wall, a first glass sheet support secured to the bottom portion, a first vertical brace extending from the bottom portion to a horizontal brace positioned proximate the back wall, the container including a first cradle portion connected to the first vertical brace and having a front surface positioned in an interior of the container, the front surface of the first cradle portion having a radius of curvature, wherein the radius of curvature of the first cradle portion generally corresponds to a radius of curvature of a glass sheet that can be placed in the container, and, a second cradle portion connected to the first vertical brace and spaced vertically from the first cradle portion and having a front surface positioned in an interior of the container, the front surface of the second cradle portion having a radius of curvature, wherein the radius of curvature of the second cradle portion generally corresponds to a radius of curvature of a glass sheet that can be placed in the container.

2. The container of claim 1 further comprising a second vertical brace extending from the bottom portion to the horizontal brace, and the first cradle portion and the second cradle portion are centered about the first vertical brace and the second vertical brace wherein loads from the glass sheets contacting the first cradle portion and the second cradle portion are transferred from the first and second vertical braces to the horizontal brace.

3. The container of claim 2 wherein the first cradle portion includes a top panel extending from the top of the front surface and a bottom panel extending from the bottom of the front surface.

4. The container of claim 1 wherein the first cradle portion and the second cradle portion are formed from a corrugated material.

5. The container of claim 4 wherein the first cradle portion and the second cradle portion are each folded from a single piece of corrugated material and include a plurality of layers of corrugated material.

6. The container of claim 1 wherein the first cradle portion is positioned proximate a back wall of the container so that the front surface of the first cradle portion is at a first distance from the back wall and the second cradle portion is positioned proximate the back wall of the container so that the front surface of the second cradle portion is at a second distance from the back wall greater than the first distance.

7. The container of claim 6 wherein the second cradle portion is positioned below the first cradle portion.

8. The container of claim 1 further comprising at least a first internal support positioned in the first cradle portion, and at least a first internal support positioned in the second cradle portion.

9. The container of claim 8 wherein the at least a first internal support in the first cradle portion, and the at least first internal support in the second cradle portion are formed from a corrugated material.

10. A container for transporting glass sheets comprising:

a back section having a back wall, a first side wall and an opposing second side wall, the back wall, first side wall and second side wall supported on a bottom portion, a first glass sheet support secured to the bottom portion;

a first vertical brace positioned proximate the back wall;

a cradle having a first cradle support portion extending from the first vertical brace and having a generally elongated rectangular shape and a second cradle support portion extending from the first vertical brace and having a generally elongated rectangular shape vertically spaced from the first cradle support portion;

a front section configured to mate with the back section to form the container.

11. The container of claim 10 wherein the first side wall includes a first front panel integrally connected to an edge of the first side wall, and the second side wall includes a second front panel integrally connected to an edge of the second side wall.

12. The container of claim 11 wherein the first front panel includes a first top flap configured to interlock with a top panel of the container, and the second front panel includes a second top flap configured to interlock with the top panel of the container.

13. The container of claim 10 wherein the bottom portion includes a pallet structure.

14. The container of claim 10 wherein the first cradle portion includes a front surface having a radius of curvature configured to match the radius of curvature of the glass sheets.

15. The container of claim 14 wherein the second cradle portion includes a front surface having a radius of curvature configured to match the radius of curvature of the glass sheets.

16. The container of claim 15 wherein the front surface of the first cradle portion is positioned a first distance from the back wall and the front surface of the second cradle portion is positioned a second distance from the back wall, wherein the second distance is greater than the first distance.

17. The container of claim 10 further comprising a second vertical brace positioned proximate the back wall.

18. The container of claim 17 further comprising a horizontal brace connected to the back wall, the horizontal brace extending from a first side of the back wall to a second side of the back wall.

19. The container of claim 18 wherein the first vertical brace and the second vertical brace extend from the bottom portion of the container to the horizontal brace.

20. The container of claim 19 wherein the first cradle portion and the second cradle portion are mounted onto the first vertical brace and the second vertical brace.

* * * * *